US009961952B2

(12) United States Patent
Durocher

(10) Patent No.: US 9,961,952 B2
(45) Date of Patent: May 8, 2018

(54) HELMET FOR IMPACT PROTECTION

(71) Applicant: BAUER HOCKEY CORP., Blainville (CA)

(72) Inventor: Jacques Durocher, St-Jerome (CA)

(73) Assignee: BAUER HOCKEY, LLC, Exeter, NH (US)

( * ) Notice: Subject to any disclaimer, the term of this patent is extended or adjusted under 35 U.S.C. 154(b) by 151 days.

(21) Appl. No.: 14/828,051

(22) Filed: Aug. 17, 2015

(65) Prior Publication Data

US 2017/0049178 A1 Feb. 23, 2017

(51) Int. Cl.
*A42B 3/00* (2006.01)
*A42B 3/12* (2006.01)

(52) U.S. Cl.
CPC ..... *A42B 3/127* (2013.01)

(58) Field of Classification Search
CPC ..... A42B 3/127; A42B 3/00; A42B 3/14
USPC ..... 2/414, 411, 416, 425
See application file for complete search history.

(56) References Cited

U.S. PATENT DOCUMENTS 3,350,718 A 11/1967 Webb
3,413,656 A 12/1968 Vogliano et al.
3,447,162 A 6/1969 Aileo
3,471,866 A 10/1969 Raney
3,609,764 A 10/1971 Morgan
3,866,243 A 2/1975 Morgan
4,012,794 A 3/1977 Nomiyama
4,023,213 A 5/1977 Rovani
4,055,860 A 11/1977 King
4,185,331 A 1/1980 Nomiyama
4,287,613 A 9/1981 Schulz
4,307,471 A 12/1981 Lovell
4,932,076 A 6/1990 Giorgio et al.
5,068,922 A * 12/1991 Zahn ..... F41H 1/04 2/411
5,204,998 A 4/1993 Liu
(Continued)

FOREIGN PATENT DOCUMENTS

CA 2290324 5/2001
CA 2273621 2/2002
(Continued)

OTHER PUBLICATIONS

Non-patent document Statement of Defence and Counterclaim in *Bauer Hockey* v. *Sport Maska*, Canadian Federal Court File No. T-123-15: Bauer 2014 Player Catalogue p. 19—RE-AKT, p. 20—Comparison RE-AKT 100, REAKT, IMS 11.0, IMS 9.0, IMS, 7500 7.0, p. 21—RE-AKT 100 with Suspended Tech 2 and VTX Technology with Seven+. See p. 22-28 for helmets, 105 pages.
(Continued)

*Primary Examiner* — Tejash Patel

(57) ABSTRACT

A helmet for protecting a head of a wearer, such as a hockey, lacrosse, football or other sports player. The helmet may have various features to protect the wearer's head against impacts, such as linear impacts and rotational impacts. For example, pads of the helmet may be movable relative to one another in response to an impact on the helmet. The helmet may comprise a frame comprising a plurality of frame members carrying respective ones of the pads and configured to move relative to one another in response to the impact to allow relative movement of the pads.

55 Claims, 25 Drawing Sheets

(56) References Cited

U.S. PATENT DOCUMENTS

| | | | | |
|---|---|---|---|---|
| 5,867,840 | A | 2/1999 | Hirosawa | |
| 5,950,244 | A | 9/1999 | Fournier et al. | |
| 6,081,931 | A | 7/2000 | Burns et al. | |
| 6,108,824 | A | 8/2000 | Fournier et al. | |
| 6,240,571 | B1 | 6/2001 | Infusino | |
| 6,298,497 | B1 | 10/2001 | Chartrand | |
| 6,324,700 | B1 | 12/2001 | McDougall | |
| 6,385,780 | B1 | 5/2002 | Racine | |
| 6,453,476 | B1 | 9/2002 | Moore | |
| 6,560,787 | B2 | 5/2003 | Mendoza | |
| 6,592,536 | B1 | 7/2003 | Argenta | |
| 6,658,671 | B1 | 12/2003 | Von Holst et al. | |
| 6,681,409 | B2 | 1/2004 | Dennis et al. | |
| 6,751,808 | B2 | 6/2004 | Puchalski | |
| 6,817,039 | B1 * | 11/2004 | Grilliot | A42B 3/122 2/413 |
| 6,920,644 | B1 | 7/2005 | Higgs | |
| 6,966,075 | B2 | 11/2005 | Racine | |
| 6,968,575 | B2 | 11/2005 | Durocher | |
| 6,981,284 | B2 | 1/2006 | Durocher | |
| 6,996,856 | B2 | 2/2006 | Puchalski | |
| 7,076,811 | B2 | 7/2006 | Puchalski | |
| 7,341,776 | B1 | 3/2008 | Milliren et al. | |
| 7,603,725 | B2 * | 10/2009 | Harris | A42B 3/121 2/410 |
| 7,634,820 | B2 | 12/2009 | Rogers et al. | |
| 7,870,618 | B2 | 1/2011 | Pilon et al. | |
| 7,908,678 | B2 | 3/2011 | Brine, III et al. | |
| 7,930,771 | B2 | 4/2011 | Depreitere et al. | |
| 8,037,548 | B2 | 10/2011 | Alexander et al. | |
| 8,095,995 | B2 | 1/2012 | Alexander et al. | |
| 8,156,574 | B2 | 4/2012 | Stokes et al. | |
| 8,296,867 | B2 | 10/2012 | Rudd et al. | |
| 8,296,868 | B2 | 10/2012 | Belanger et al. | |
| 8,316,512 | B2 | 11/2012 | Halldin | |
| 8,448,266 | B2 | 5/2013 | Alexander et al. | |
| 8,566,968 | B2 | 10/2013 | Marzec et al. | |
| 8,566,969 | B2 | 10/2013 | Glogowski et al. | |
| 8,578,520 | B2 | 11/2013 | Halldin | |
| 8,832,870 | B2 | 9/2014 | Belanger et al. | |
| 8,887,318 | B2 | 11/2014 | Mazzarolo et al. | |
| 9,095,179 | B2 | 8/2015 | Kwan et al. | |
| 2001/0032351 | A1 | 10/2001 | Nakayama et al. | |
| 2003/0221245 | A1 | 12/2003 | Lee et al. | |
| 2004/0025231 | A1 | 2/2004 | Ide et al. | |
| 2004/0117896 | A1 | 6/2004 | Madey et al. | |
| 2004/0168246 | A1 | 9/2004 | Phillips | |
| 2004/0199981 | A1 | 10/2004 | Tucker | |
| 2004/0250340 | A1 | 12/2004 | Piper et al. | |
| 2006/0059606 | A1 | 3/2006 | Ferrara | |
| 2006/0096011 | A1 * | 5/2006 | Dennis | A42B 3/08 2/414 |
| 2006/0206994 | A1 | 9/2006 | Rogers et al. | |
| 2007/0083965 | A1 | 4/2007 | Darnell et al. | |
| 2007/0157370 | A1 | 7/2007 | Joubert Des Ouches | |
| 2007/0190292 | A1 | 8/2007 | Ferrara | |
| 2007/0199136 | A1 | 8/2007 | Brine et al. | |
| 2007/0245466 | A1 | 10/2007 | Lilenthal et al. | |
| 2007/0266481 | A1 | 11/2007 | Alexander | |
| 2008/0066217 | A1 | 3/2008 | Depreitere et al. | |
| 2008/0155735 | A1 | 7/2008 | Ferrara | |
| 2008/0276354 | A1 | 11/2008 | Stokes | |
| 2008/0289085 | A1 | 11/2008 | Bryant | |
| 2009/0031482 | A1 | 2/2009 | Stokes et al. | |
| 2009/0038055 | A1 | 2/2009 | Ferrara | |
| 2009/0044315 | A1 | 2/2009 | Belanger et al. | |
| 2009/0158506 | A1 | 6/2009 | Thompson et al. | |
| 2009/0178184 | A1 | 7/2009 | Brine et al. | |
| 2010/0005573 | A1 | 1/2010 | Rudd et al. | |
| 2010/0043126 | A1 | 2/2010 | Morel | |
| 2010/0050323 | A1 | 3/2010 | Durocher et al. | |
| 2010/0107317 | A1 | 5/2010 | Wang | |
| 2010/0115686 | A1 | 5/2010 | Halldin | |
| 2010/0180363 | A1 | 7/2010 | Glogowski et al. | |
| 2010/0186150 | A1 | 7/2010 | Ferrara et al. | |
| 2011/0004980 | A1 | 1/2011 | Leatt et al. | |
| 2011/0047679 | A1 | 3/2011 | Rogers et al. | |
| 2011/0083251 | A1 | 4/2011 | Mandell | |
| 2011/0117310 | A1 | 5/2011 | Anderson et al. | |
| 2011/0171420 | A1 | 7/2011 | Yang | |
| 2012/0060251 | A1 | 3/2012 | Schimpf | |
| 2012/0096631 | A1 | 4/2012 | King et al. | |
| 2012/0110720 | A1 | 5/2012 | Mazzarolo et al. | |
| 2012/0198604 | A1 | 8/2012 | Weber et al. | |
| 2012/0204329 | A1 | 8/2012 | Faden et al. | |
| 2012/0208032 | A1 | 8/2012 | Faden et al. | |
| 2013/0000018 | A1 | 1/2013 | Rudd et al. | |
| 2013/0061371 | A1 | 3/2013 | Phipps et al. | |
| 2013/0122256 | A1 | 5/2013 | Kleiven et al. | |
| 2013/0247284 | A1 | 9/2013 | Hoshizaki et al. | |
| 2015/0089722 | A1 | 4/2015 | Berry | |
| 2015/0089724 | A1 | 4/2015 | Berry | |
| 2015/0113718 | A1 | 4/2015 | Bayer | |
| 2015/0216248 | A1 | 8/2015 | Blair | |

FOREIGN PATENT DOCUMENTS

| | | | |
|---|---|---|---|
| CA | 2321399 | 3/2002 | |
| CA | 2357690 | 3/2003 | |
| CA | 2437626 | 2/2005 | |
| CA | 2573639 | 1/2006 | |
| CA | 2573640 | 1/2006 | |
| CA | 2598015 | 8/2006 | |
| CA | 2561540 | 3/2007 | |
| CA | 2533493 | 7/2007 | |
| CA | 2638703 | 2/2009 | |
| CA | 2659638 | 9/2009 | |
| CA | 2804937 | 9/2009 | |
| CA | 2798542 | 11/2011 | |
| CA | 2759915 | 2/2012 | |
| EP | 1142495 | 10/2001 | |
| EP | 1429635 | 6/2004 | |
| GB | 191419109 | 8/1914 | |
| JP | 2005146468 | 6/2005 | |
| SE | 518223 | 9/2002 | |
| SE | 1050458 | 12/2011 | |
| SE | 534868 | 1/2012 | |
| WO | 96/14768 | 5/1996 | |
| WO | 0145526 | 6/2001 | |
| WO | 2006/005143 | 1/2006 | |
| WO | 2006005183 | 1/2006 | |
| WO | 2008085108 | 7/2008 | |
| WO | 2008103107 | 8/2008 | |
| WO | 2010082919 | 7/2010 | |
| WO | 2010/122586 | 10/2010 | |
| WO | 2010/151631 | 12/2010 | |
| WO | 2011/139224 | 11/2011 | |
| WO | WO 2015166598 A1 * | 11/2015 | A42B 3/12 |

OTHER PUBLICATIONS

Non-patent document Further Amended Statement of Claim in *MIPS* v. *Bauer Hockey*, Federal Court of Canada File No. T-56-15: Screenshot of Youtube video, Bikeskills.com: MIPS Helmet Technology, uploaded Sep. 25, 2009, https://www.youtube.com/watch?v=9wtb_R4NxS8, 1 page.

Non-patent document Statement of Defence and Counterclaim in *Bauer Hockey* v. *Sport Maska*, Canadian Federal Court File No. T-123-15: Easton Hockey 2008 Product Catalogue p. 38-40 Stealth S-17 with MonoLock and in Form Fit System, 43 pages.

Non-patent document Statement of Defence and Counterclaim in *Bauer Hockey* v. *Sport Maska*, Canadian rederal Court File No. T-123-15: Easton Hockey 2009 Product Catalogue p. 39-40 Stealth S-17 with MonoLock and in Form Fit System, 43 pages.

Non-patent document Statement of Defence and Counterclaim in *Bauer Hockey* v. *Sport Maska*, Canadian Federal Court File No. 1-123-15: Easton Hockey 2011 Product Catalogue p. 24 Stealth S-17, S-13, 59 pages.

Non-patent document Statement of Defence and Counterclaim in *Bauer Hockey* v. *Sport Maska*, Canadian Federal Court File No. T-123-15: Easton Hockey 2012 Product Catalogue p. 19 E700 with

(56) References Cited

OTHER PUBLICATIONS

EPP foam liner and Fit System p. 20, Stealth S13, E300 29, 46 pages.
Non-patent document Statement of Defence and Counterclaim in *Bauer Hockey* v. *Sport Maska*, Canadian Federal Court File No. T-123-15: Easton Hockey 2013 Product Catalogue, p. 14-15 R800 with Hexagonal Liner System, p. 16E700, p. 17 E300, 45 pages.
Non-patent document Statement of Defence and Counterclaim in *Bauer Hockey* v. *Sport Maska*, Canadian Federal Court File No. 1-123-15: Easton Hockey 2014 Product Catalogue, p. 16-18 E-Series Helmets, 48 pages.
Non-patent document Statement of Defence and Counterclaim in *Bauer Hockey* v. *Sport Maska*, Canadian Federal Court File No. T-123-15: Mission Itech 2007 Product Catalogue p. 24-27 Mission INTAKE Helmet with Mission Head Lock and Trip Padding, 60 pages.
Non-patent document Statement of Defence and Counterclaim in *Bauer Hockey* v. *Sport Maska*, Canadian Federal Court File No. T-123-15: Mission Itech 2008 Product Catalogue p. 22-23 Mission Intake Helmet with Mission Head Lock and Trip Padding, 57 pages.
Non-patent document Statement of Defence and Counterclaim in *Bauer Hockey* v. *Sport Maska*, Canadian Federal Court File No. T-123-15: Reebok CCM Hockey Product 2014 Catalogue—p. 38-39 CCM Resistance Helmet RES 300, RES 100, 112 pages.
Non-patent document Further Amended Statement of Claim in *MIPS* v. *Bauer Hockey*, Federal Court of Canada File No. T-56-15: Screenshot of Youtube video, LAZER MIPS, uploaded Jul. 8, 2011, https://www.youtube.com/watch?v=5jGxLmBP9CQ, 1 page.
Non-patent document referred to in Further Amended Statement of Claim in *MIPS* v. *Bauer Hockey*, Federal Court of Canada File No. T-56-15: Certified U.S. Appl. No. 61/333,817, filed May 12, 2010, 28 pages.
Non-patent document referred to in Further Amended Statement of Claim in *MIPS* v. *Bauer Hockey*, Federal Court of Canada File No. T-56-15: Non-Disclosure Agreement between Bauer Hockey Corp. and MIPS AB, Mar. 18, 2011, 3 pages.
Non-patent document referred to in Further Amended Statement of Claim in *MIPS* v. *Bauer Hockey*, Federal Court of Canada File No. T-56-15: Consulting agreement between Bauer Hockey Corp. and MIPS AB, Mar. 15, 2011, 18 pages.
Non-patent document referred to in Further Amended Statement of Claim in *MIPS* v. *Bauer Hockey*, Federal Court of Canada File No. T-56-15: Email dated Sep. 21, 2010 from Jean-Francois Laperriere to Johan Thiel; subject "MIPS in Bauer hockey helmet", 3 pages.
Non-patent document referred to in Further Amended Statement of Claim in *MIPS* v. *Bauer Hockey*, Federal Court of Canada File No. T-56-15: MIPS AB Written Report of Jul. 9, 2011, 14 pages.
Non-patent document referred to in Further Amended Statement of Claim in *MIPS* v. *Bauer Hockey*, Federal Court of Canada File No. T-56-15: Email dated Jul. 9, 2011, from Jean-Francois Laperriere to Johan Thiel; subject "Bauer in Stockholm", 1 page.
Non-patent document referred to in Further Amended Statement of Claim in *MIPS* v. *Bauer Hockey*, Federal Court of Canada File No. T-56-15: MIPS patent portfolio, Jul. 27, 2011, 2 pages.
Non-patent document referred to in Further Amended Statement of Claim in *MIPS* v. *Bauer Hockey*, Federal Court of Canada File No. T-56-15: Petition of Canadian Patent 2,784,316, filed Jul. 27, 2012, 4 pages.
Non-patent document referred to in Further Amended Statement of Claim in *MIPS* v. *Bauer Hockey*, Federal Court of Canada File No. T-56-15: Letter dated Jan. 17, 2012, from Kevin Davis to Niklas Steenberg, subject "MIPS-Bauer cooperation", 2 pages.
Non-patent document referred to in Further Amended Statement of Claim in *MIPS* v. *Bauer Hockey*, Federal Court of Canada File No. T-56-15: Email dated Jul. 29, 2011, from Marie-Claude Genereux to Johan Thiel; subject "MIPS patent number", 1 page.
Non-patent document referred to in Further Amended Statement of Claim in *MIPS* v. *Bauer Hockey*, Federal Court of Canada File No. T-56-15: Confidential Patent Application, Jul. 29, 2011, 24 pages.
International Search Report dated Mar. 16, 2015 in connection with International Patent Application PCT/CA2014/000911, 8 pages.
Written Opinion of the International Searching Authority dated Mar. 16, 2015 in connection with International Patent Application PCT/CA2014/000911, 9 pages.
Advance Impact Defence, 6D Helmets, http://www.6dhelmets.com/#!ods/c10b6, consulted on Nov. 26, 2014.
Xenith, Heads-up: Tech to Combat Concussions, http://www.xenith.com/the-game/2012/08/heads-up-tech-to-combat-concussions., consulted on Nov. 26, 2014.
Xenith Technology, Adaptive Head Protection, http://www.xenith.com/why-x/technology, consulted on Nov. 26, 2014.
Non-final Office Action dated Aug. 17, 2015 in connection with U.S. Appl. No. 13/560,546, 38 pages.
Further Amended Statement of Claim, MIPS AB and Bauer Hockey Corp. and Bauer Hockey, Inc. (hereinafter "*MIPS* v. *Bauer Hockey*"), Document filed at the Federal Court of Canada on Jan. 15, 2015, amended on Apr. 24, 2015, and further amended Nov. 20, 2015, Court File No. T-56-15, 44 pages.
Statement of Defence and Counterclaim, Bauer Hockey Corp and Sport Maska Inc. and Reebok-CCM Hockey (hereinafter "*Bauer Hockey* v. *Sport Maska*"), Document filed at the Federal Court of Canada on Jul. 3, 2015, Cout File No. T-123-15, 29 pages.
Statement of Fact and Arguments in Support of Opposition of European Patent No. 2,550,886 (hereinafter "Opposition of European Patent No. 2,550,886"), Document filed at the EP Patent Office on Dec. 31, 2014, 54 pages.
Non-patent document Further Amended Statement of Claim in *MIPS* v. *Bauer Hockey*, Federal Court of Canada File No. T-56-15; Gulli, Cathy et al., "Hits to the head: Scientists explain Sidney Crosby's concussion" Macleans, Feb. 17, 2011, document retrieved on Sep. 23, 2015 at http://www.macleans.ca/society/health/thereaftershocks/, 9 pages.
Non-patent document Further Amended Statement of Claim in *MIPS* v. *Bauer Hockey*, Federal Court of Canada File No. T-56-15: Lazer Booth at Interbike in Las Vegas (Sep. 22-24, 2010)—Public display of Lazer P'Nut Helmet with MIPS technology, with MIPS product tags, MIPS poster, MIPS PowerPoint presentation, 47 pages.
Non-patent document Further Amended Statement of Claim in *MIPS* v. *Bauer Hockey*, Federal Court of Canada File No. T-56-15: Public presentation of Lazer P'Nut helmet with MIPS system at the LazerSports NV event "Lazer Oazis Party", Hard Rock Café, Las Vegas, Sep. 21, 2010—Public display of Lazer P' Nut Helmet with MIPS technology, MIPS Tech-folder and poster, PowerPoint presentation, 47 pages.
Non-patent document Further Amended Statement of Claim in *MIPS* v. *Bauer Hockey*, Federal Court of Canada File No. T-56-15: Promotion of MIPS technology during meetings at Intennot 2010 in Cologne, Germany (Oct. 6-10, 2010)—Public display of MIPS technology, with MIPS product tags, MIPS poster, MIPS PowerPoint presentation, 15 pages.
Non-patent document Further Amended Statement of Claim in *MIPS* v. *Bauer Hockey*, Federal Court of Canada File No. T-56-15: MIPS Press Release titled "MIPS protection system to offer enhanced protective technology in Burton's R.E.D. snow helmets", Stockholm, Sweden, Jan. 17, 2011, 2 pages.
Non-patent document Further Amended Statement of Claim in *MIPS* v. *Bauer Hockey*, Federal Court of Canada File No. T-56-15: MIPS Booth that Snow Sports Industries America (SIA) in Denver (Jan. 27-30, 2011)—Public display of Burton RED Hi-Fi MIPS Helmet, Limar Helmet with MIPS technology, POC Receptor Backcountry with MIPS technology, MIPS product tags, MIPS poster, MIPS PowerPoint presentation, 12 pages.
Non-patent document Further Amended Statement of Claim in *MIPS* v. *Bauer Hockey*, Federal Court of Canada File No. T-56-15: MIPS Booth that ISPO 2011 in Munich (Feb. 6-9, 2011)—Public display of Burton RED Hi-Fi MIPS Helmet, Limar Helmet with MIPS technology, POC Receptor Backcountry with MIPS technology, MIPS product tags, MIPS poster, MIPS PowerPoint presentation, 50 pages.
Non-patent document Further Amended Statement of Claim in *MIPS* v. *Bauer Hockey*, Federal Court of Canada File No. T-56-15:

(56) References Cited

OTHER PUBLICATIONS

Presentation about the Lazer P-nut with MIPS to Lazer distributors and agents, May-Jun. 2011, including Peter Steenwegen of Lazer, 12 pages.
Non-patent document Further Amended Statement of Claim in *MIPS* v. *Bauer Hockey*, Federal Court of Canada File No. T-56-15: Bicycle Retailer Article titled "Lazer to Add Eyewear to Helmet Line", published on Jun. 26, 2011, 3 pages.
Non-patent document Further Amended Statement of Claim in *MIPS* v. *Bauer Hockey*, Federal Court of Canada File No. T-56-15: MIPS Press Release titled "MIPS and Lazer Join Forces to Protect Children's Brains", Stockholm, Sweden, Aug. 25, 2011, 1 page.
Non-patent document Further Amended Statement of Claim in *MIPS* v. *Bauer Hockey*, Federal Court of Canada File No. T-56-15: Lazer Booth at EuroBike in Friedrichshafen, Germany (Aug. 31-Sep. 2, 2011)—Public displays of Lazer P'Nut Helmet with MIPS technology, with MIPS product tags, MIPS poster, MIPS PowerPoint presentation, 19 pages.
Non-patent document Further Amended Statement of Claim in *MIPS* v. *Bauer Hockey*, Federal Court of Canada File No. T-56-15: POC Booth at Eurobike in Friedrichshafen, Germany (Aug. 31-Sep. 2, 2011)—Public displays of POC Trabec Helmet with MIPS technology, with MIPS product tags, 18 pages.
Non-patent document Further Amended Statement of Claim in *MIPS* v. *Bauer Hockey*, Federal Court of Canada File No. T-56-15: POC Booth at Interbike in Las Vegas (Sep. 12-16, 2011)—Public display of POC Trabec Helmet with MIPS technology, with MIPS product tags, 18 pages.
Non-patent document Further Amended Statement of Claim in *MIPS* v. *Bauer Hockey*, Federal Court of Canada File No. T-56-15: Lazer Booth at Interbike in Las Vegas (Sep. 12-16, 2011)—Public display of Lazer P'Nut Helmet with MIPS technology, with MIPS product tags, MIPS poster, MIPS PowerPoint presentation, 19 pages.
Non-patent document Further Amended Statement of Claim in *MIPS* v. *Bauer Hockey*, Federal Court of Canada File No. T-56-15: Föregående, Nästa, SvD Sport Article titled "Valdet mot huvudet skakar om hockeyn", published on Nov. 27, 2011, English translation enclosed, 11 pages.
Non-patent document Further Amended Statement of Claim in *MIPS* v. *Bauer Hockey*, Federal Court of Canada File No. T-56-15: SvT Sport Online Article titled "Nytt skydd kan halvera hjarnskador", published on Nov. 6, 2011, English translation enclosed, 4 pages.
Non-patent document Further Amended Statement of Claim in *MIPS* v. *Bauer Hockey*, Federal Court of Canada File No. T-56-15: NyTeknik Article titled "Ridhjalmen skyddar hjarnan vid cykelvurpa", published on Oct. 6, 2009, No English translation enclosed, 2 pages.
Non-patent document Further Amended Statement of Claim in *MIPS* v. *Bauer Hockey*, Federal Court of Canada File No. T-56-15: Almi Foretagspartner Article titled "MIPS genomfor riktad nyemission till HealthCap, KTH-Chalmers Capital och Almi Invest f6r kommersialisering av MIPS-teknologin", published Oct. 20, 2009, No English translation enclosed, 2 pages.
Non-patent document Further Amended Statement of Claim in *MIPS* v. *Bauer Hockey*, Federal Court of Canada File No. T-56-15: Hippson Article titled "Skallskador är inte bara hjärnskakning", published on Apr. 6, 2007, No English translation enclosed, 19 pages.
Non-patent document Further Amended Statement of Claim in *MIPS* v. *Bauer Hockey*, Federal Court of Canada File No. T-56-15: Magnus Aare & Peter Halldin (2003), "A New Laboratory Rig for Evaluating Helmets Subject to Oblique Impacts", Traffic Injury Prevention, 4:3, pp. 240-248.
Non-patent document Further Amended Statement of Claim in *MIPS* v. *Bauer Hockey*, Federal Court of Canada File No. T-56-15: Hjalmen som hamar hjarnans eget skydd in Fokus: Flemingsberg, Nov. 2007, No English translation enclosed, 16 pages.
Non-patent document Opposition of European Patent No. 2,550,886: USPTO, Certified U.S. Appl. No. 61/512,266, filed Jul. 27, 2011, 27 pages.
Non-patent document Opposition of European Patent No. 2,550,886: USPTO, Certified U.S. Appl. No. 61/587,040, filed Jan. 16, 2012, 71 pages.
Non-patent document Opposition of European Patent No. 2,550,886: Request for grant of a European patent filed at the European Patent Office, filed Jul. 27, 2012 in connection with European Patent Application 12178380.7, 5 pages.
Non-patent document Opposition of European Patent No. 2,550,886: Statement under 37 CRF 3.73(c) and two Assignments filed in connection with U.S. Appl. No. 13/560,546 (U.S. Publication 201310025032), completed Sep. 5, 2012 and Sep. 10, 2012, 6 pages.
Non-patent document Opposition of European Patent No. 2,550,886: Interview with Bauer Hockey: RE-AKT-Helmet; Hockey World Blog article dated May 11, 2012; http: / /www. hockeyworldblog.com /2012/05/11 /interview-with-bauer-hockey-re-akt-helmet/; retrieved Dec. 16, 2014, 4 pages.
Non-patent document Opposition of European Patent No. 2,550,886: Witness statement from Mattias Eidelbrekt dated Dec. 29, 2014 filed in the matter of an opposition to European Patent Application 2,550,886 in the name of Bauer Hockey Corp., 1 page.
Non-patent document Opposition of European Patent No. 2,550,886: Email exchanges in connection with RE-AKT order placed on May 14, 2012, 8 pages.
Non-patent document Opposition of European Patent No. 2,550,886: Photographs of purchased RE-AKT helmet (related to Email exchanges in connection with RE-AKT order placed on May 14, 2012); photographs taken May 31, 2012, 14 pages.
Non-patent document Opposition of European Patent No. 2,550,886: Screenshots from Ice Warehouse YouTube video, video available at https://www.youtube.com/watch?v-eHKOeKTI8k, video published Apr. 27, 2012, video retrieved/screenshots taken Dec. 3, 2014, 8 pages.
Non-patent document Opposition of European Patent No. 2,550,886: Transcript of Ice Warehouse YouTube video, video available at https://www.youtube.com/watch?v-eHKOeKTI8k, video published Apr. 27, 2012, video retrieved/transcript taken Dec. 3, 2014, 3 pages.
Non-patent document Opposition of European Patent No. 2,550,886: Email conversation re MIPS Reebok helmet sent to Pat Brisson—Feb. 16-29, 2012, 3 pages.
Non-patent document Opposition of European Patent No. 2,550,886: Email conversation copying Daniel Lanner—Feb. 6-24, 2012, 3 pages.
Non-patent document Opposition of European Patent No. 2,550,886: Images of MIPS Reebok helmet, Photographs taken Dec. 29, 2014, 11 pages.
Non-patent document Opposition of European Patent No. 2,550,886: Witness statement from Daniel Lanner dated Dec. 26, 2014, filed in the matter of an opposition to European Patent Application 2,550,886 in the name of Bauer Hockey Corp., 1 page.
Non-patent document Statement of Defence and Counterclaim in *Bauer Hockey* v. *Sport Maska*, Federal Court of Canada File No. T-123-15: CNW Group Ltd., "Bauer Hockey Unveils Revolutionary New Products During BauerWorld 2012", Orlando, FL, Oct. 27, 2011, document retrieved on Sep. 22, 2015 at http://www.newswire.ca/newsreleases/bauerhockeyunveilsrevolutionary-newproductsduringbauerworld2012508943451.html, 4 pages.
Non-patent document Further Amended Statement of Claim in *MIPS* v. *Bauer Hockey*, Federal Court of Canada File No. T-56-15: Schwarz, Alan, "Helmet Safety Unchanged as Injury Concerns Rise", The New York Times, Published on Oct. 20, 2010, document retrieved on Sep. 23, 2015 at http://www.nytimes.com/2010/10/21/sports/football/21helmets.html?pagewanted=all&_r=0, 9 pages.
Non-patent document Further Amended Statement of Claim in *MIPS* v. *Bauer Hockey*, Federal Court of Canada File No. T-56-15: Pacocha, Mall, "The Cult of Aluminum is Alive and Well. 2012 Lazer helmets and eyewear—First look", Jul. 1, 2011, document

(56) References Cited

OTHER PUBLICATIONS retrieved on Sep. 23, 2015 at http://www.bikeradar.com/news/article/20121azerhelmetsandeyewearfirstlook30811/, 9 pages.
Non-patent document Opposition of European Patent No. 2,550,886: Witness statement from Daniel Lanner dated Dec. 22, 2014, re NHL presentation in Apr. 2012 filed in the matter of an opposition to European Patent Application 2,550,886 in the name of Bauer Hockey Corp., 1 page.
Non-patent document Opposition of European Patent No. 2,550,886: Email dated Apr. 16, 2012 from Niklas Steenberg to Daniel Lanner; subject "Reebok hjalm" with its English translation, 2 pages.
Non-patent document Opposition of European Patent No. 2,550,886: Email dated Apr. 16, 2012 from Niklas Steenberg to Daniel Lanner; subject "Re: SV: Reebok-CCM" with its English translation, 2 pages.
Non-patent document Opposition of European Patent No. 2,550,886: Witness statement from Peter Halldin dated Dec. 22, 2014, re NHL presentation on Apr. 19, 2012 and RBK meeting on Apr. 20, 2012 filed in the matter of an opposition to European Patent Application 2,550,886 in the name of Bauer Hockey Corp., 1 page.
Non-patent document Opposition of European Patent No. 2,550,886: Email dated Apr. 17, 2012 from Niklas Steenberg to Peter Halldin; subject "NHLoch ReebokCCM" with its English translation, 11 pages.
Non-patent document Opposition of European Patent No. 2,550,886: Email dated Apr. 30, 2012 from Brian Jennings to Niklas Steenberg and Peter Halldin; subject "Re: MIPS meeting in NYC", 2 pages.
Non-patent document Opposition of European Patent No. 2,550,886: Witness statement from Daniel Lanner dated Dec. 22, 2014, re helmet for Ludvig Steenberg, presented to Lars Steenberg on Jul. 3, 2012 filed in the matter of an opposition to European Patent Application 2,550,886 in the name of Bauer Hockey Corp., 1 page.
Non-patent document Opposition of European Patent No. 2,550,886: Witness statement from Lars Steenberg dated Dec. 29, 2015, re helmet for Ludvig Steenberg presented to Lars Steenberg on Jul. 3, 2012 filed in the matter of an opposition to European Patent Application 2,550,886 in the name of Bauer Hockey Corp., 1 page.
Non-patent document Opposition of European Patent No. 2,550,886: Internal MIPS specification document "Specification: MIPS in Hockey helmets", dated Mar. 15, 2012, 4 pages.
Non-patent document Opposition of European Patent No. 2,550,886: Images re display of Lazer P'Nut at "Lazer Oasiz Party", Hard Rock Cafe, Las Vegas, Sep. 21, 2010, 3 pages.
Non-patent document Opposition of European Patent No. 2,550,886: Witness statement from Johan dated Dec. 29, 2014 re Las Vegas display of Lazer P'Nut helmet filed in the matter of an opposition to European Patent Application 2,550,886 in the name of Bauer Hockey Corp., 1 page.
Non-patent document Opposition of European Patent No. 2,550,886: Lazer invoice of Dec. 16, 2010 for space rented at Las Vegas event, 1 page.
Non-patent document Opposition of European Patent No. 2,550,886: Digital Mechanics silicon tooling invoice Sep. 17, 2010, 3 pages.
Non-patent document Opposition of European Patent No. 2,550,886: Guest list for "Lazer Oasiz Party", 8 pages.
Non-patent document Opposition of European Patent No. 2,550,886: Lazer Interbike flyer, 1 page.
Non-patent document Opposition of European Patent No. 2,550,886: Slides from sales presentation made to Lazer distributors, 29 pages.
Non-patent document Opposition of European Patent No. 2,550,886: Slides from P'Nut presentation made to Lazer distributors, 6 pages.
Non-patent document Opposition of European Patent No. 2,550,886: Witness statement from Johan Thiel dated Dec. 29, 2014, 1 page.
Non-patent document Opposition of European Patent No. 2,550,886: Transcript of video shown at presentation. Video viewable at: http://www.mipshelmet.com/video/Lazer/pnut presentation, 1 page.
Non-patent document Opposition of European Patent No. 2,550,886: Screenshots from video viewable at: http://www.mipshelmet.com/video/Lazer/pnut presentation, 5 pages.
Non-patent document Opposition of European Patent No. 2,550,886: Lazer to Add Eyewear to Helmet Line, Bicycle Retailer (www.bicycleretailer.com) article published on Jun. 26, 2011; http://www.bicycleretailer.com/product-tech/2011/06/26/lazer-add-eyewear-helmet-line; retrieved Dec. 4, 2014, 3 pages.
Non-patent document Opposition of European Patent No. 2,550,886: New Helmet Technology Reduces Brain Injury, KTH website article (ww.kth.se); https://www.kth.se/en/aktuellt/nyheter/new-helmet-technology-reduces-brain-injury-1.299392; published Mar. 7, 2012; retrieved Dec. 30, 2014, 3 pages.
Non-patent document Opposition of European Patent No. 2,550,886: Burton RED HiFi design drawings from Oct. 24, 2010, 3 pages.
Non-patent document Opposition of European Patent No. 2,550,886: Images in connection with Burton RED HiFi helmets, displayed at SIA Denver exhibition Jan. 27-30, 2011; 3D Model images from Dec. 2010, sample photographs incorporating HiFi sliding facilitator in hockey helmet from Jan. 20, 2011 and photographs of SIA Display booth taken Jan. 27, 2011, 19 pages.
Non-patent document Opposition of European Patent No. 2,550,886: MIPS/Burton press release dated Jan. 17, 2011, 2 pages.
Non-patent document Opposition of European Patent No. 2,550,886: Witness statement from Johan Thiel, dated Dec. 29, 2014, regarding display of Burton RED HiFi helmet at SIA exhibition in Jan. 2011, 1 page.
Non-patent document Opposition of European Patent No. 2,550,886: Screenshots from Dec. 2010 Limar video. Video viewable at: http://www.mipshelmet.com/video/inmold/Limar, 2 pages.
Non-patent document Opposition of European Patent No. 2,550,886: MIPS press release, Aug. 25, 2011, 1 page.
Non-patent document Opposition of European Patent No. 2,550,886: Nytt skydd kan halvera hjarnskador, SVT article (www.svt.se) dated Nov. 6, 2011; http://www.svt.se/sport/nytt-skydd-kan-halvera-hjarnskador-1; retrieved Dec. 18, 2014 with its English translation, 4 pages.
Non-patent document Opposition of European Patent No. 2,550,886: Vildet mot huvudet skakar om hockey, SVD article (www.svd.se); http: / /www. svd. se/ sport/valdet-mot-huvudet-skakar-om- hockevn 6666590.svd; published Nov. 27, 2011; retrieved Dec. 24, 2014 with its english translation, 11 pages.
Non-patent document Opposition of European Patent No. 2,550,886: Photographs relating to display of Lazer P'Nut helmet at Eurobike exhibition 2011; exhibition held in Friedrichshafen, Germany, Aug. 31-Sep. 3, 2011; photographs taken Sep. 1-2, 17 pages.
Non-patent document Opposition of European Patent No. 2,550,886: Witness statement from Johan Thiel, dated Dec. 29, 2014, re display at Eurobike, 1 page.
Non-patent document Opposition of European Patent No. 2,550,886: HKSM order Aug. 17, 2011, 1 page.
Non-patent document Opposition of European Patent No. 2,550,886: HKSM order Sep. 9, 2011, 1 page.
Non-patent document Opposition of European Patent No. 2,550,886: Witness statement from Johan Thiel, dated Dec. 29, 2014 re HKSM orders, 1 page.
Non-patent document Opposition of European Patent No. 2,550,886: MNR/Article overview for order Mq11005435—Mar. 17, 2011, 1 page.
Non-patent document Opposition of European Patent No. 2,550,886: Purchase order for test and sample units dated May 13, 2011, 2 pages.
Non-patent document Opposition of European Patent No. 2,550,886: Delivery note dated Nov. 24, 2011, 3 pages.

(56) References Cited

OTHER PUBLICATIONS

Non-patent document Opposition of European Patent No. 2,550,886: Photographs relating to display of POC Trabec helmet at Eurobike exhibition 2011; exhibition held in Friedrichshafen, Germany, Aug. 31, 2011-Sep. 3, 2011; photographs taken Aug. 18, 2011, Sep. 2, 2011, Oct. 12 and 14, 2011, 18 pages.
Non-patent document Opposition of European Patent No. 2,550,886: Witness statement from Johan Thiel, dated Dec. 29, 2014, re display of POC Trabec at Eurobike 2011, 1 page.
Non-patent document Statement of Defence and Counterclaim in *Bauer Hockey* v. *Sport Maska*, Federal Court of Canada File No. T-123-15: Nike Bauer 2006 Product Catalogue p. 42-45 Nike Bauer 8500 Helmet with Tool-Free Adjustment and Occipital Lock; 98 pages.
Non-patent document Statement of Defence and Counterclaim in *Bauer Hockey* v. *Sport Maska*, Federal Court of Canada File No. T-123-15:Nike Bauer 2007 Product Catalogue p. 30 Nike Bauer 8500 Helmet with Tool-Free Adjustment and Occipital Lock, 72 pages.
Non-patent document Statement of Defence and Counterclaim in *Bauer Hockey* v. *Sport Maska*, Federal Court of Canada File No. T-123-15: Bauer 2009 Product Catalogue p. 49 Bauer 5100 Helmet with Dual-Density Liner and Tool-Free Adjustment, 144 pages.
Non-patent document Statement of Defence and Counterclaim in *Bauer Hockey* v. *Sport Maska*, Federal Court of Canada File No. T-123-15: Bauer 2010 Product Catalogue p. 42 Bauer 7500 Helmet with Triple-density protection, EPP1/2 liner, PORON inserts and Tool-Free Adjustment and Bauer 9900 Helmet with FXPP foam, PORON inserts, Occipital Lock 2.0 and Tool-Free Adjustment, 174 pages.
Non-patent document Statement of Defence and Counterclaim in *Bauer Hockey* v. *Sport Maska*, Federal Court of Canada File No. T-123-15: Bauer 2011 Product Catalogue p. 44-45, Bauer 9900, p. 46 Bauer 7500 Helmet, p. 47 Bauer 5100 Helmet, 188 pages.
Non-patent document Statement of Defence and Counterclaim in *Bauer Hockey* v. *Sport Maska*, Federal Court of Canada File No. T-123-15: Bauer 2012 Product Catalogue p. 44-48 Introducing Bauer RE-AKT with Suspend-Tech liner system, Vertex foam protection, Poron, occipital lock 3.0 and tool-free adjustment p. 48—Bauer 9900 and 7500 Helmets, p. 49 Bauer 5100 Helmet, 122 pages.
Non-patent document Statement of Defence and Counterclaim in *Bauer Hockey* v. *Sport Maska*, Federal Court of Canada File No. T-123-15: Bauer 2013 Player Catalogue p. 45—Bauer IMS 11.0 Helmet with Seven Technology, p. 47—RE-AKT, 48—RE-AKT, IMS 11.0, IMS 9.0, p. 49—Bauer 7500 and IMS 7.0, p. 50-5100, 118 pages.
Final Office Action dated Aug. 24, 2016, in connection with U.S. Appl. No. 13/560,546, 10 pages.
Notice of Allowance dated May 10, 2017, in connection with U.S. Appl. No. 13/560,546, 9 pages.
Office Action dated Oct. 6, 2016, in connection with U.S. Appl. No. 14/139,049, 14 pages.
Final Office Action dated Jul. 13, 2017, in connection with U.S. Appl. No. 14/139,049, 5 pages.
EpicWaySports, "Bikeskills.com: MIPS Helmet Technology", YouTube video, uploaded Sep. 25, 2009 (https://www.youtube.com/watch?v=9wtb_R4NxS8).
Lazer Sports, "LAZER MIPS", YouTube video, uploaded Jul. 8, 2011 (https://www.youtube.com/watch?v=5jGxLmBP9CQ).
Burton RED Hi-hi MIPS Helmet provided to Bauer on Jul. 12, 2011.
Dimock Stratton LLP, "MIPS AB and Bauer Hockey Ltd. and Bauer Hockey, LLC, Thrice Amended Statement of Claim", Document filed at the Federal Court of Canada on Jun. 19, 2017, Court File No. T-56-15, 46 pages.
Smart & Biggar, "MIPS AB and Bauer Hockey Ltd. and Bauer Hockey, LLC, Further Amended Statement of Defence and Counterclaim", Document filed at the Federal Court of Canada on Jun. 21, 2017, Court File No. T-56-15, 14 pages.
DLA Piper (Canada) LLP, "MIPS AB and Bauer Hockey Ltd. and Bauer Hockey, LLC, Amended Reply and Defence to Counterclaim", Document filed at the Federal Court of Canada on Jul. 21, 2017, Court File No. 1-56-15, 13 pages.
Summons to attend oral proceedings, issued by the opposition division of the European Patent Office, issued on Jul. 6, 2017, in connection with European Patent 2550886, 33 pages.

* cited by examiner

HELMET FOR IMPACT PROTECTION

FIELD

The invention relates generally to helmets and, more particularly, to helmets providing protection against impacts (e.g., while engaged in sports or other activities).

BACKGROUND

Helmets are worn in sports (e.g., hockey, lacrosse, football, etc.) and other activities (e.g., motorcycling, industrial work, military activities, etc.) to protect their wearers against head injuries. To that end, helmets typically comprise a rigid outer shell and inner padding to absorb energy when impacted.

Various types of impacts are possible. For example, a helmet may be subjected to a linear impact in which an impact force is generally oriented to pass through a center of gravity of the wearer's head and imparts a linear acceleration to the wearer's head. A helmet may also be subjected to a rotational impact in which an impact force imparts an angular acceleration to the wearer's head. This can cause serious injuries such as concussions, subdural hemorrhage, or nerve damage. Also, a helmet may experience high-energy impacts (e.g., greater than 40 Joules) and/or low-energy impacts (e.g., 40 Joules or less) that can cause different kinds of harm or injury.

Although helmets typically provide decent protection against linear impacts, their protection against rotational impacts is often deficient. This is clearly problematic given the severity of head injuries caused by rotational impacts.

Also, while various forms of protection against linear impacts have been developed, existing techniques may not always be adequate or optimal in some cases, such as for certain types of impacts (e.g., high- and low-energy impacts).

For these and other reasons, there is a need for improvements directed to providing helmets with enhanced impact protection.

SUMMARY OF THE INVENTION

According to various aspects of the invention, there is provided a helmet for protecting a head of a wearer. The helmet may have various features to protect the wearer's head against impacts, such as linear impacts and rotational impacts. For instance, pads of the helmet may be movable relative to one another in response to an impact on the helmet. The helmet may comprise a frame comprising a plurality of frame members carrying respective ones of the pads and configured to move relative to one another in response to the impact to allow relative movement of the pads.

For example, according to an aspect of the invention, there is provided a helmet for protecting a head of a wearer. The helmet comprises an outer shell and inner padding disposed within the outer shell. The inner padding comprises a plurality of pads configured to move relative to one another in response to an impact on the helmet.

According to another aspect of the invention, there is provided a helmet for protecting a head of a wearer. The helmet comprises an outer shell and inner padding disposed within the outer shell. The inner padding comprises a plurality of pads and a frame carrying the pads and configured to allow the pads to move relative to one another in response to an impact on the helmet.

According to another aspect of the invention, there is provided a helmet for protecting a head of a wearer. The helmet comprises an outer shell and inner padding disposed within the outer shell. The inner padding comprises a plurality of pads and a frame carrying the pads. The frame comprises a plurality of frame members carrying respective ones of the pads and configured to move relative to one another in response to an impact on the helmet.

These and other aspects of the invention will now become apparent to those of ordinary skill in the art upon review of the following description of embodiments of the invention in conjunction with the accompanying drawings.

BRIEF DESCRIPTION OF THE DRAWINGS

A detailed description of embodiments of the invention is provided below, by way of example only, with reference to the accompanying drawings, in which.

It is to be expressly understood that the description and drawings are only for the purpose of illustrating certain embodiments of the invention and are an aid for understanding. They are not intended to be a definition of the limits of the invention.

DETAILED DESCRIPTION OF EMBODIMENTS

FIGS. 1 to 10 show an example of a helmet 10 for protecting a head 11 of a wearer in accordance with an embodiment of the invention. In this embodiment, the helmet 10 is a sports helmet for protecting the head 11 of the wearer who is a sports player. More particularly, in this embodiment, the helmet 10 is a hockey helmet for protecting the head 11 of the wearer who is a hockey player. In other embodiments, the helmet 10 may be any other type of helmet for other sports (e.g., lacrosse, football, baseball, bicycling, skiing, snowboarding, horseback riding, etc.) and activities other than sports (e.g., motorcycling, industrial applications, military applications, etc.) in which protection against head injury is desired.

The helmet 10 defines a cavity 13 for receiving the wearer's head 11 to protect the wearer's head 11 when the helmet 10 is impacted (e.g., when the helmet 10 hits a board or an ice or other skating surface of a hockey rink or is struck by a puck or a hockey stick). In this embodiment, the helmet 10 is designed to provide protection against various types of impacts. More particularly, in this embodiment, the helmet 10 is designed to provide protection against a linear impact in which an impact force is generally oriented to pass through a center of gravity of the wearer's head 11 and imparts a linear acceleration to the wearer's head 11. In addition, in this embodiment, the helmet 10 is designed to provide protection against a rotational impact in which an impact force imparts an angular acceleration to the wearer's head 11. The helmet 10 is also designed to protect against high-energy impacts and low-energy impacts.

In response to an impact, the helmet 10 absorbs energy from the impact to protect the wearer's head 11. Notably, in this embodiment, as further discussed below, pads of the helmet 10 are movable relative to one another in response to an impact on the helmet 10. This can enhance protection of the wearer's head 11. For example, this may provide protection against rotational impacts, by absorbing rotational energy from the rotational impact, thereby reducing rotational energy transmitted to the wearer's head 11 and, therefore, an angular acceleration of the wearer's 11.

Figure 11:
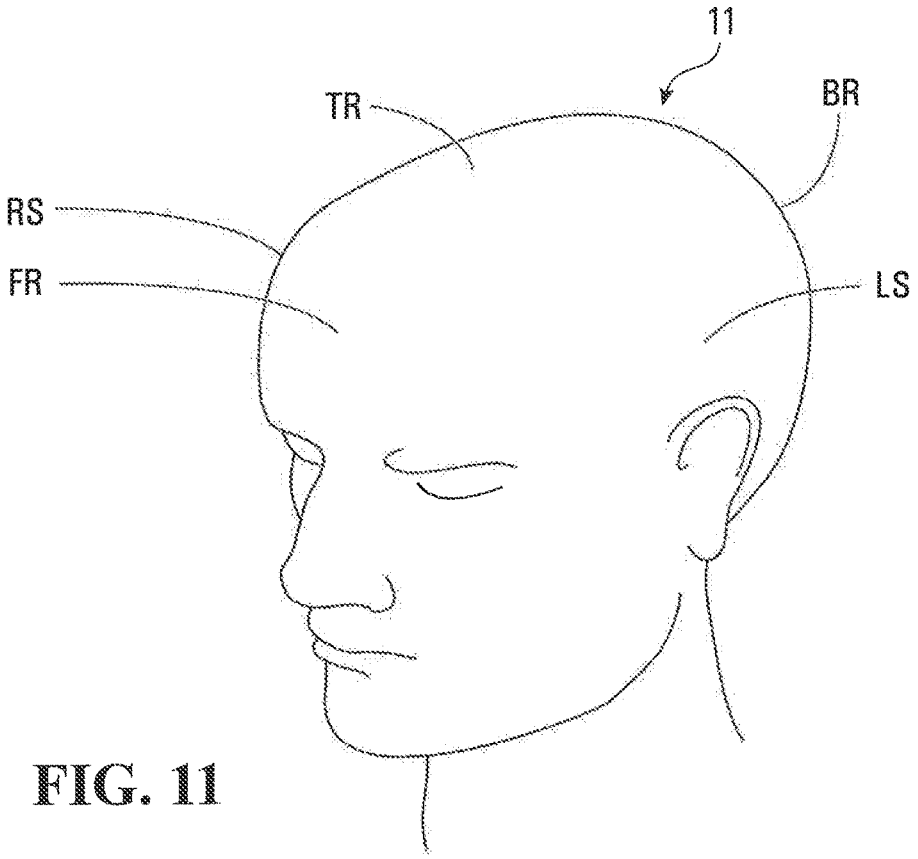
FIGS. 11 and 12 show the head of the wearer.
Figure 12:
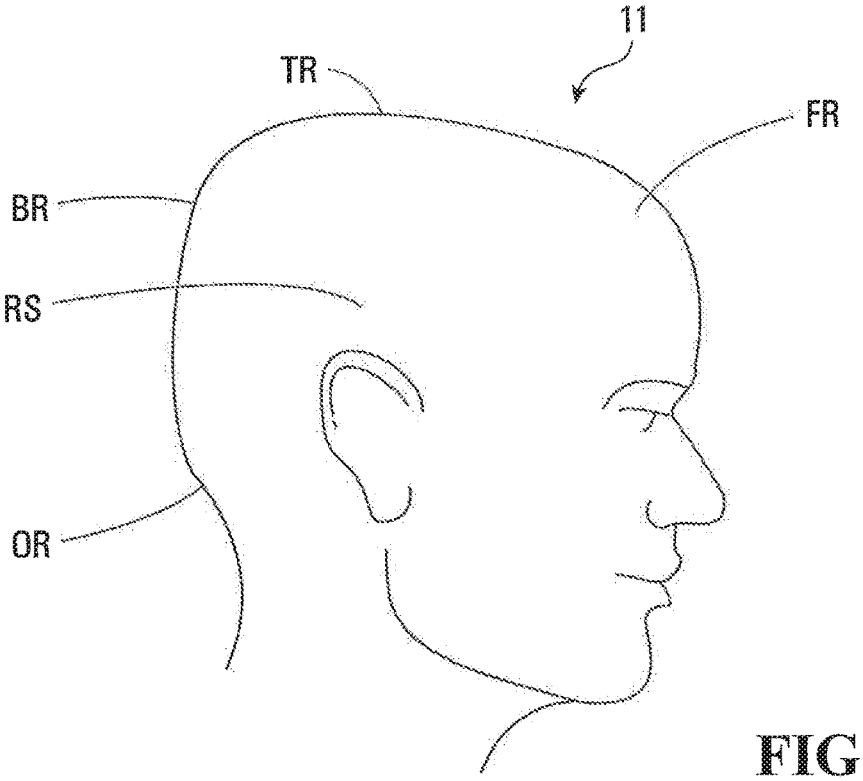

The helmet 10 protects various regions of the wearer's head 11. As shown in FIGS. 11 and 12, the wearer's head 11 comprises a front region FR, a top region TR, left and right side regions LS, RS, a back region BR, and an occipital region OR. The front region FR includes a forehead and a front top part of the head 11 and generally corresponds to a frontal bone region of the head 11. The left and right side regions LS, RS are approximately located above the wearer's ears. The back region BR is opposite the front region FR and includes a rear upper part of the head 11. The occipital region OR substantially corresponds to a region around and under the head's occipital protuberance.

The helmet 10 comprises an external surface 18 and an internal surface 20 that contacts the wearer's head 11 when the helmet 10 is worn. The helmet 10 has a front-back axis FBA, a left-right axis LRA, and a vertical axis VA which are respectively generally parallel to a dorsoventral axis, a dextrosinistral axis, and a cephalocaudal axis of the wearer when the helmet 10 is worn and which respectively define a front-back direction, a left-right direction, and a vertical direction of the helmet 10. Since they are generally oriented longitudinally and transversally of the helmet 10, the front-back axis FBA and the left-right axis LRA can also be referred to as a longitudinal axis and a transversal axis, respectively, while the front-back direction and the left-right direction can also be referred to a longitudinal direction and a transversal direction. A length L of the helmet 10 is a dimension of the helmet 10 in its longitudinal direction, a width W of the helmet 10 is a dimension of the helmet 10 in its transversal direction, and a height H of the helmet 10 is a dimension of the helmet 10 in its vertical direction.

Figure 13:
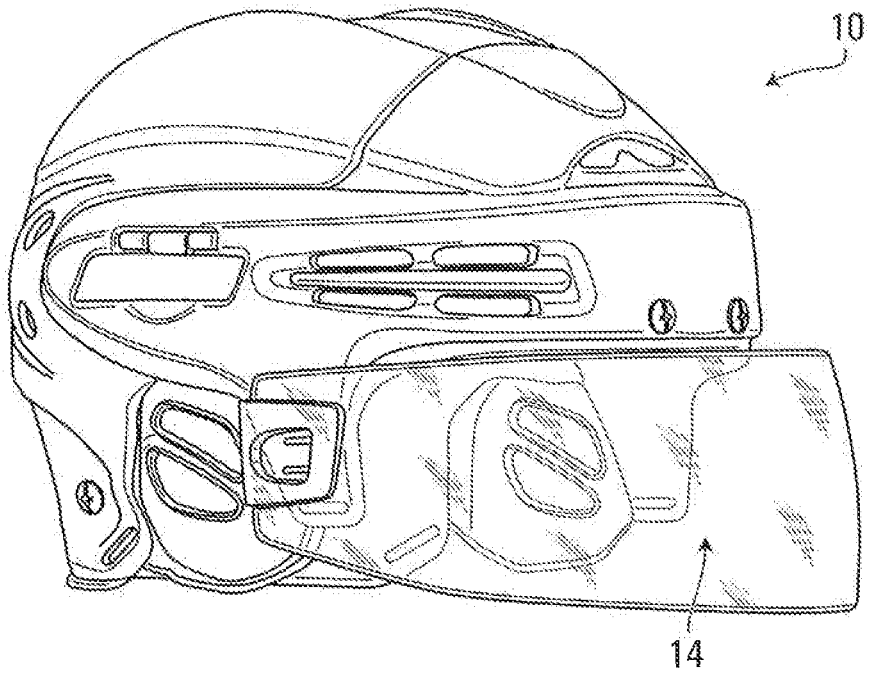
FIGS. 13 and 14 show examples of a faceguard that may be provided on the helmet.
Figure 14:
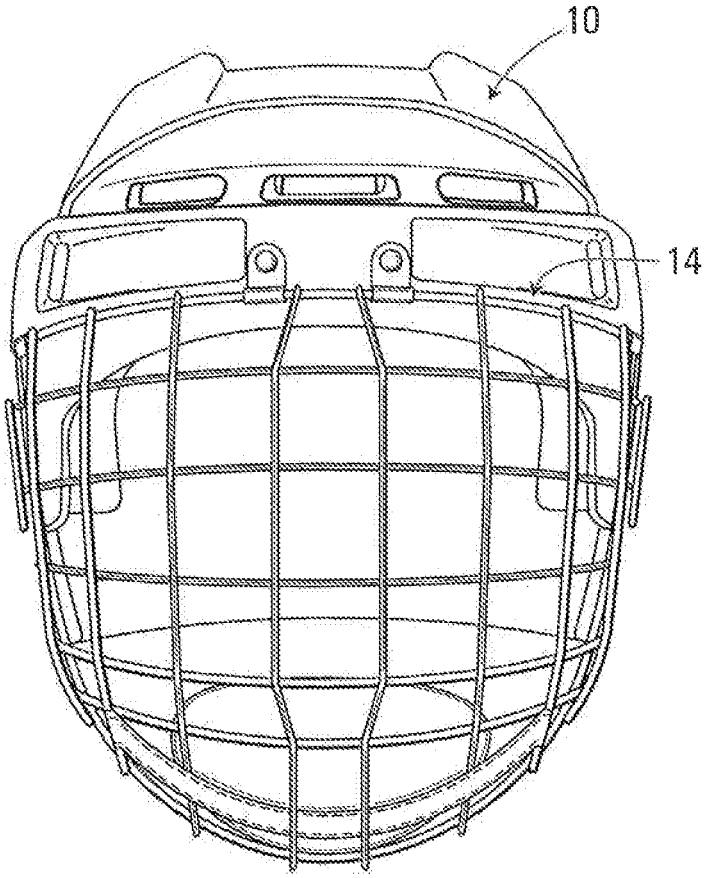

In this embodiment, the helmet 10 comprises an outer shell 12 and inner padding 15. The helmet 10 also comprises a chinstrap 16 for securing the helmet 10 to the wearer's head 11. As shown in FIGS. 13 and 14, the helmet 10 may also comprise a faceguard 14 to protect at least part of the wearer's face (e.g., a grid (sometimes referred to as a "cage") or a visor (sometimes referred to as a "shield")).

The outer shell 12 provides strength and rigidity to the hockey helmet 10. To that end, the outer shell 12 is made of rigid material. For example, in various embodiments, the outer shell 12 may be made of thermoplastic material such as polyethylene (PE), polyamide (nylon), or polycarbonate, of thermosetting resin, or of any other suitable material. The outer shell 12 has an inner surface 17 facing the inner padding 15 and an outer surface 19 opposite the inner surface 17. The outer surface 19 of the outer shell 12 constitutes at least part of the external surface 18 of the helmet 10.

In this embodiment, the outer shell 12 comprises a front outer shell member 22 and a rear outer shell member 24 that are connected to one another. The front outer shell member 22 comprises a top portion 21 for facing at least part of the top region TR of the wearer's head 11, a front portion 23 for facing at least part of the front region FR of the wearer's head 11, and left and right lateral side portions 25, 27 extending rearwardly from the front portion 23 for facing at least part of the left and right side regions LS, RS of the wearer's head 11. The rear outer shell member 24 comprises a top portion 29 for facing at least part of the top region TR of the wearer's head 11, a back portion 31 for facing at least part of the back region BR of the wearer's head 11, an occipital portion 37 for facing at least part of the occipital region OR of the wearer's head 11, and left and right lateral side portions 33, 35 extending forwardly from the back portion 31 for facing at least part of the left and right side regions LS, RS of the wearer's head 11.

Figure 15:
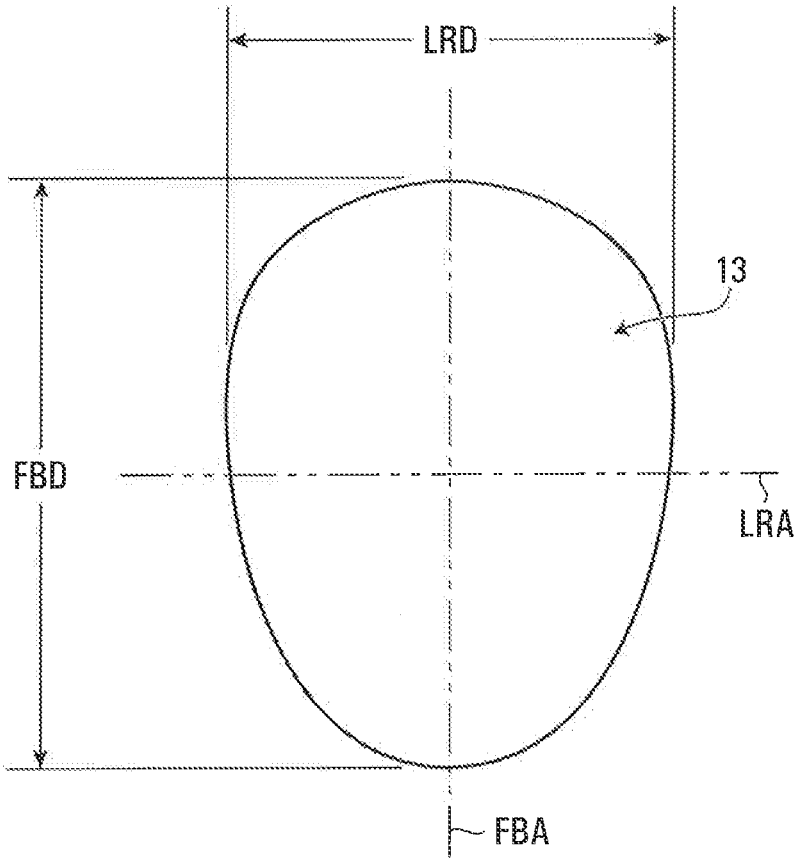
FIG. 15 shows internal dimensions of a head-receiving cavity of the helmet.
Figure 16:
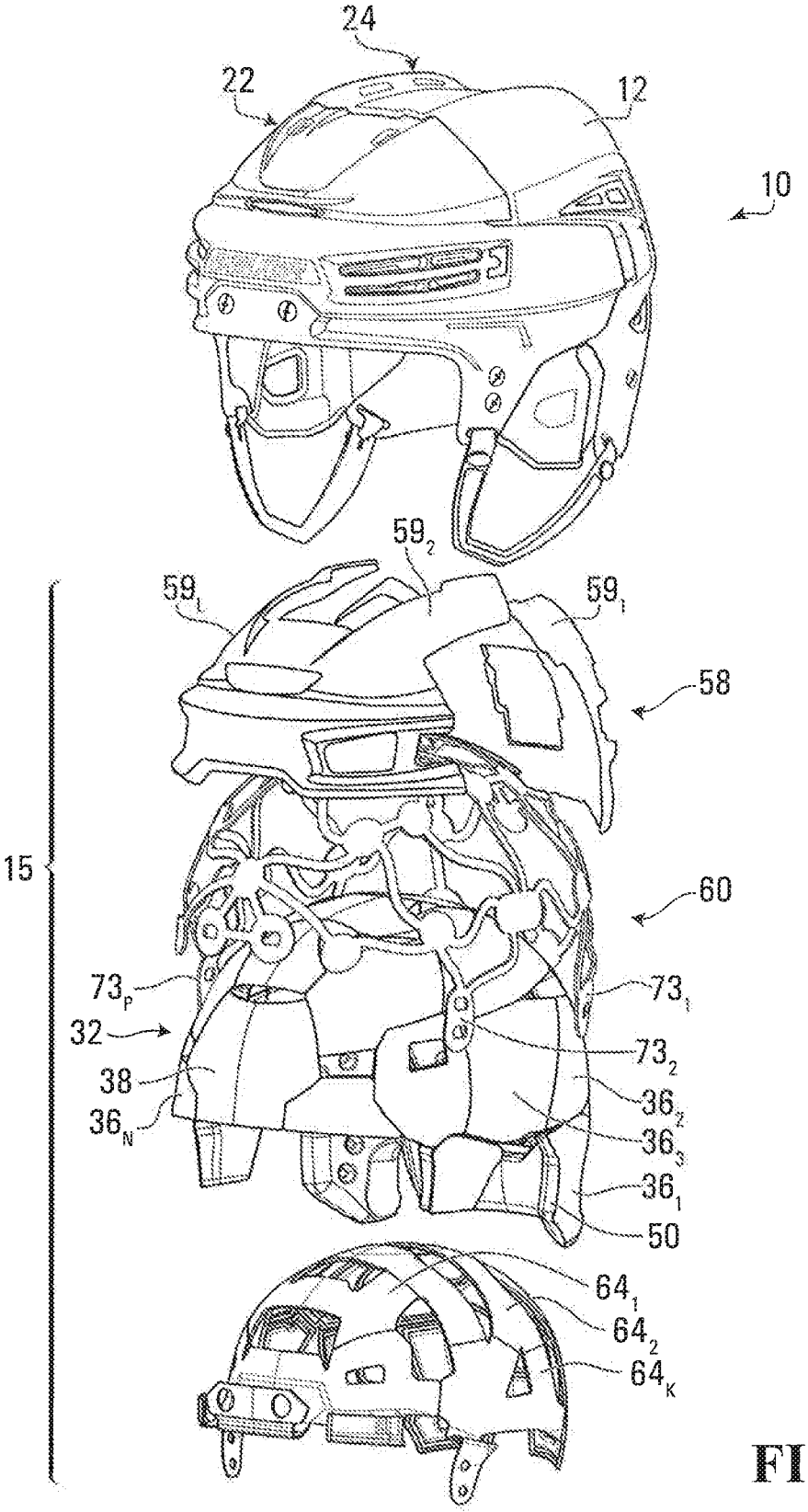
FIG. 16 shows a perspective exploded view of the helmet.
Figure 17A:
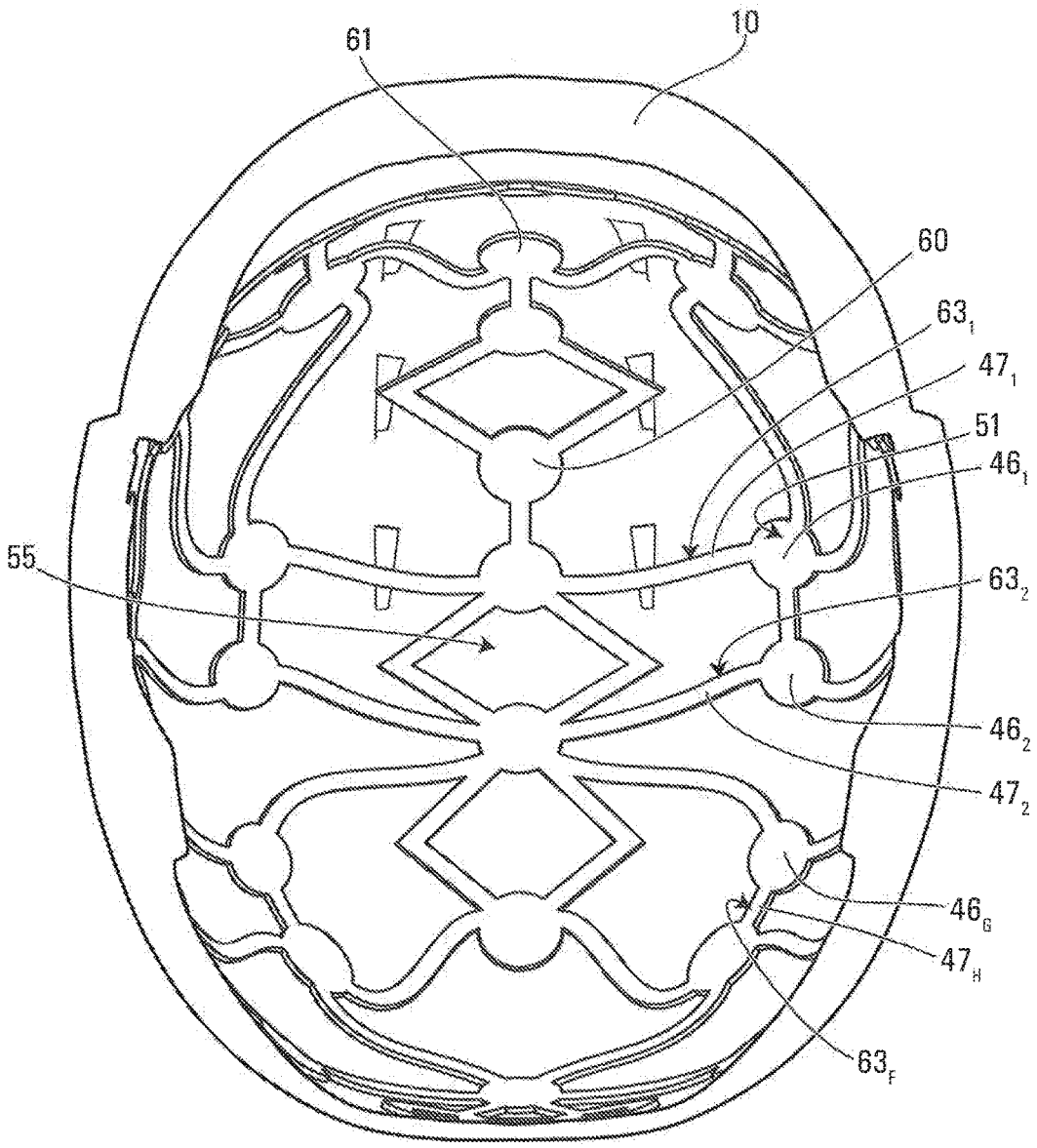
FIGS. 17A, 17B and 17C show inside views of various components of the helmet.
Figure 17B:
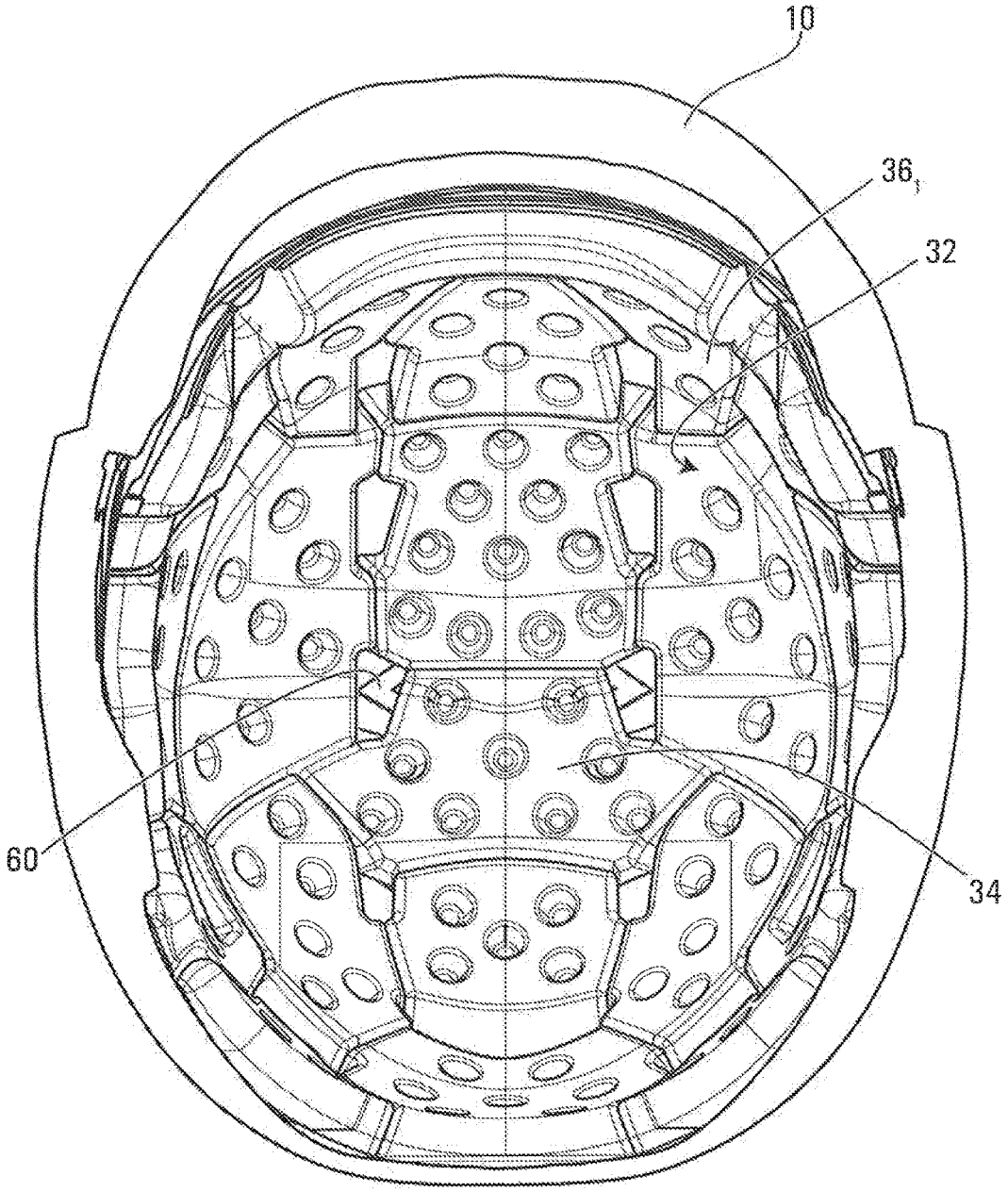
Figure 17C:
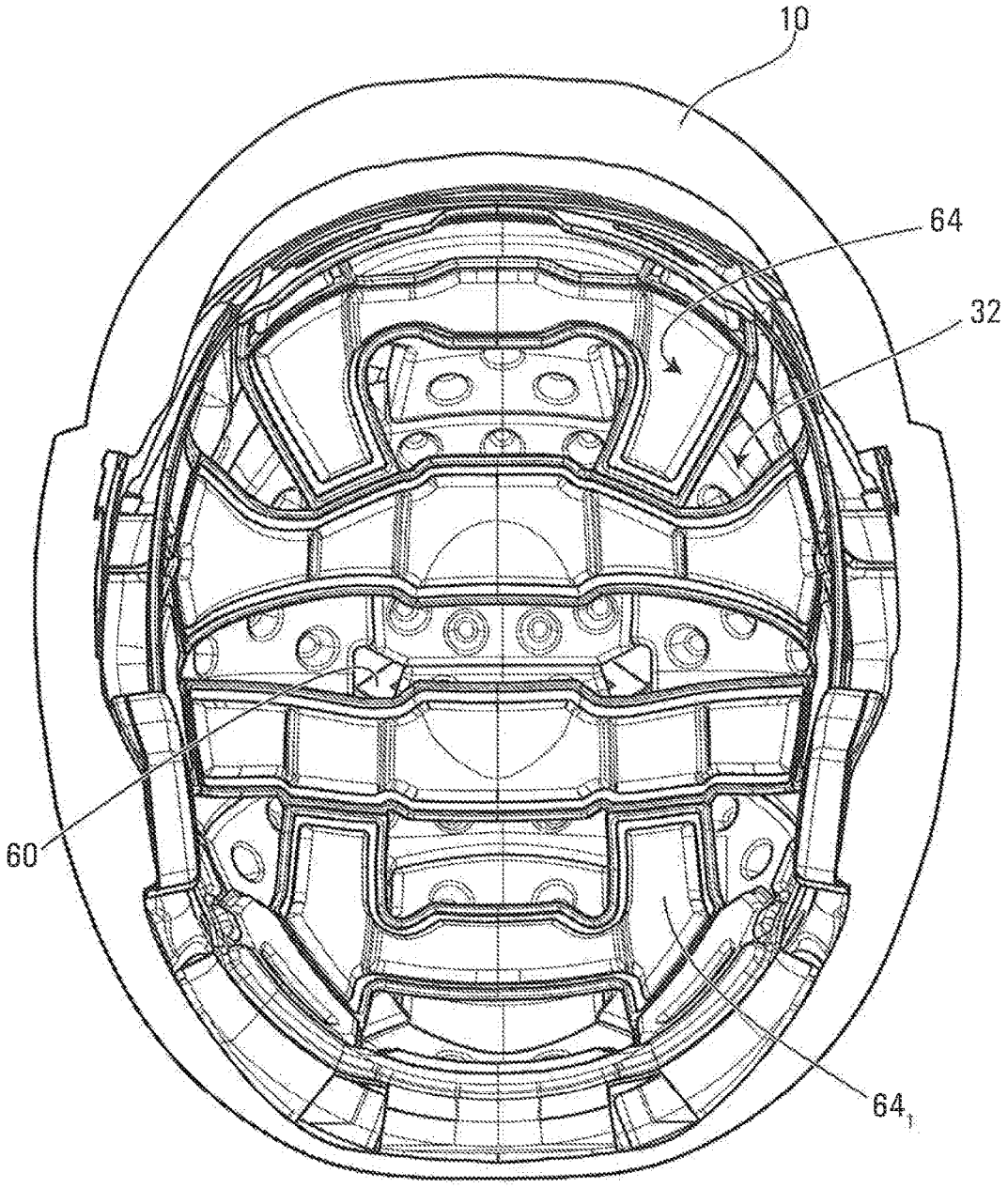

In this embodiment, the helmet 10 is adjustable to adjust how it fits on the wearer's head 11. To that end, the helmet 10 comprises an adjustment mechanism 40 for adjusting a fit of the helmet 10 on the wearer's head 11. The adjustment mechanism 40 allows the fit of the helmet 10 to be adjusted by adjusting one or more internal dimensions of the cavity 13 of the helmet 10, such as a front-back internal dimension FBD of the cavity 13 in the front-back direction of the helmet 10 and/or a left-right internal dimension LRD of the cavity 13 in the left-right direction of the helmet 10, as shown in FIG. 15.

Figure 1:
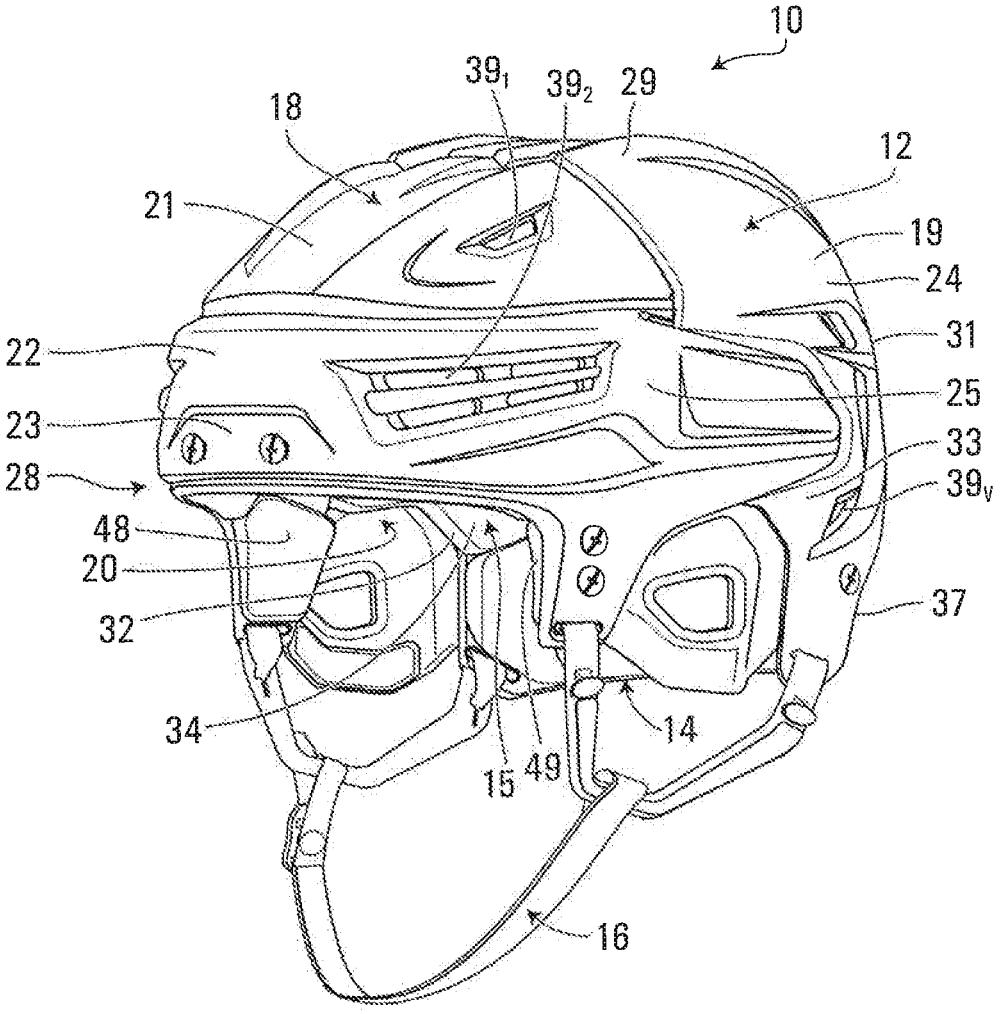
FIG. 1 shows an example of a helmet for protecting a head of a wearer in accordance with an embodiment of the invention.
Figure 2:
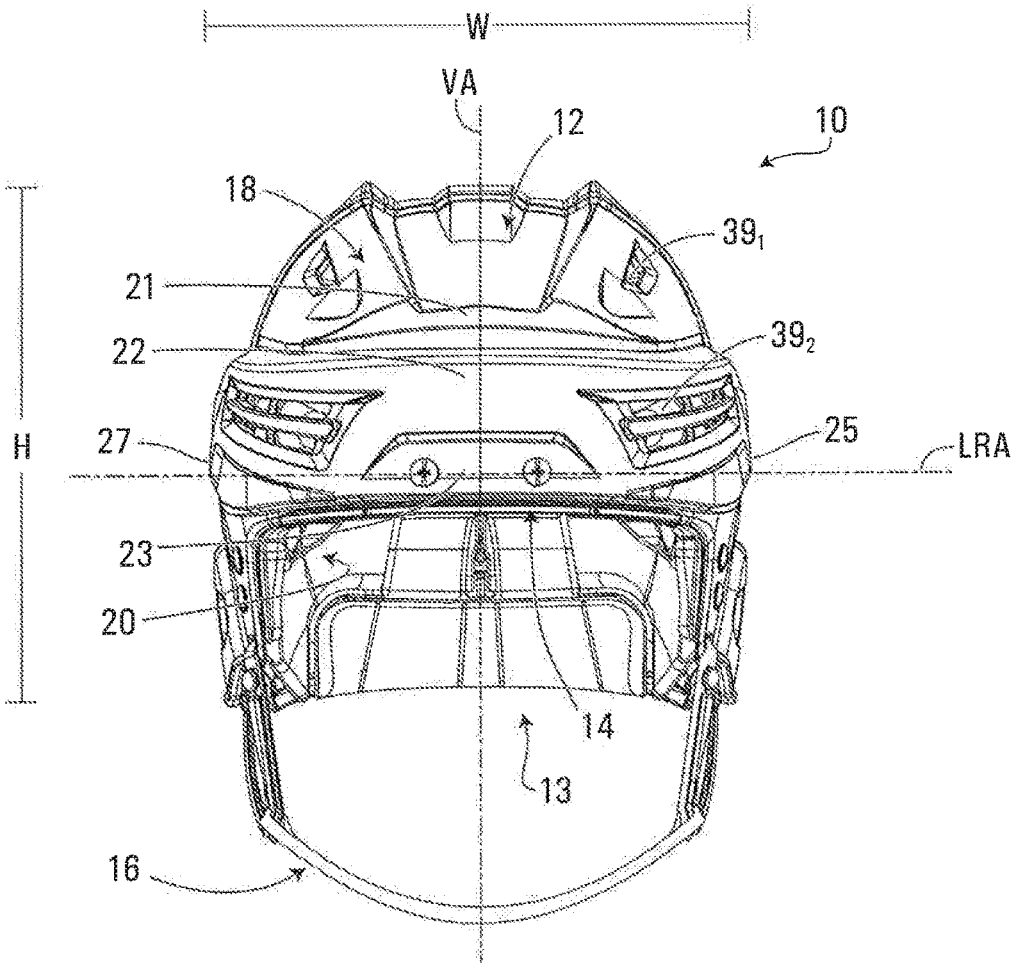
FIGS. 2 and 3 show a front and rear perspective view of the helmet.
Figure 3:
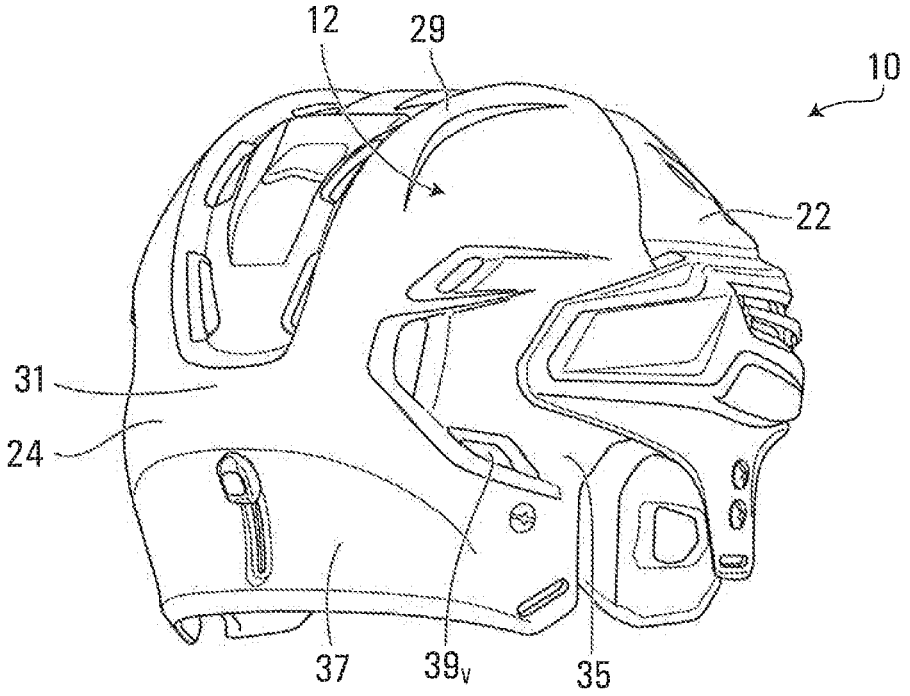
Figure 4:
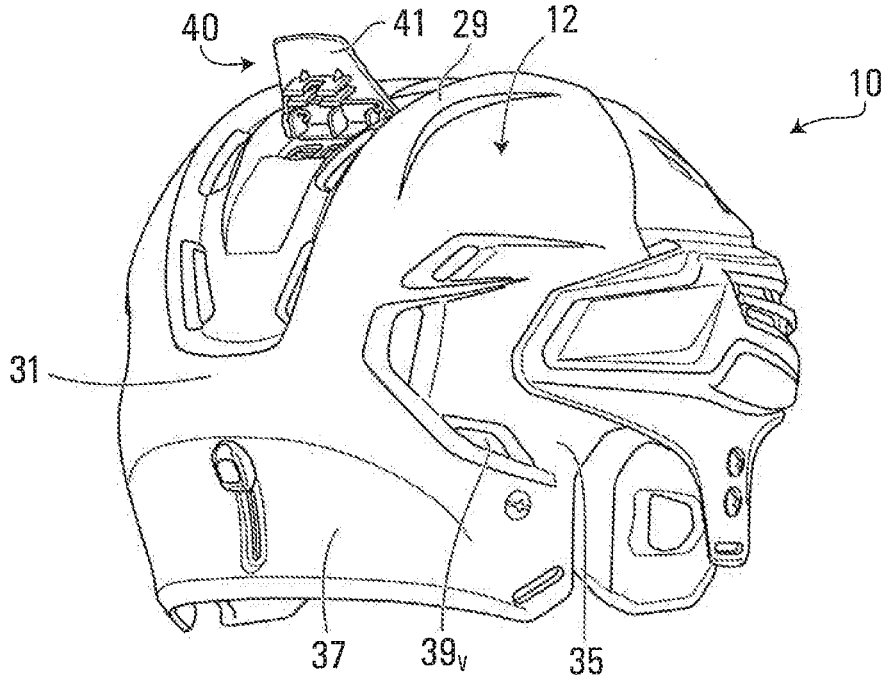
FIGS. 4 to 8 show operation of an example of an adjustment mechanism of the helmet.
Figure 5:
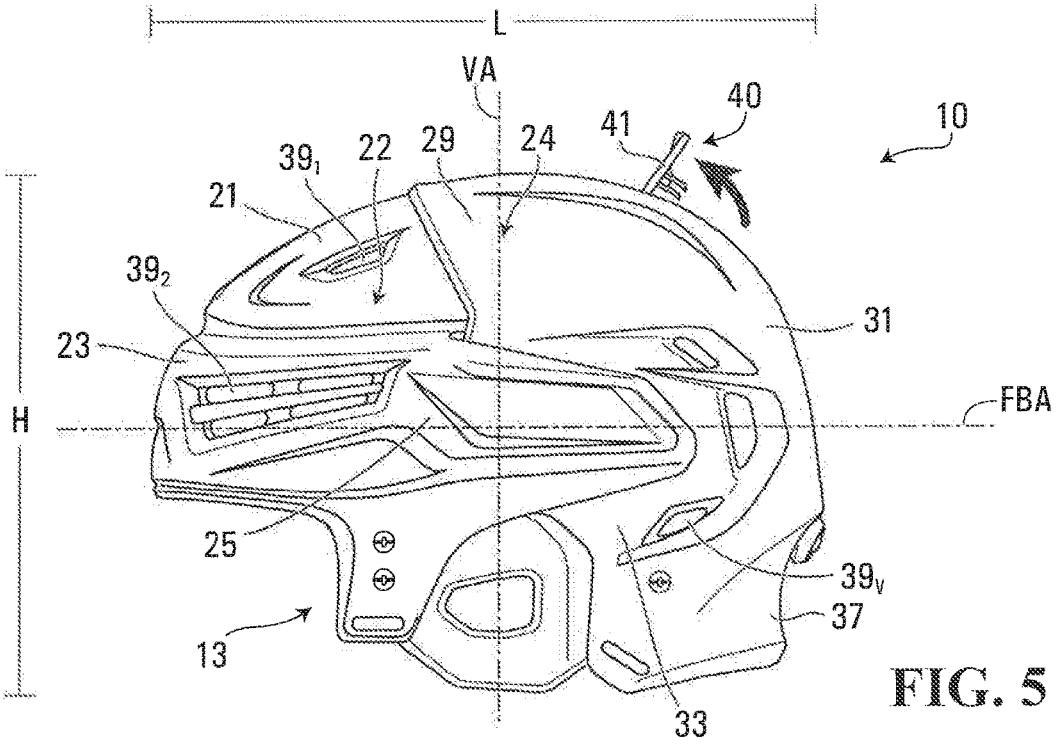
Figure 6:
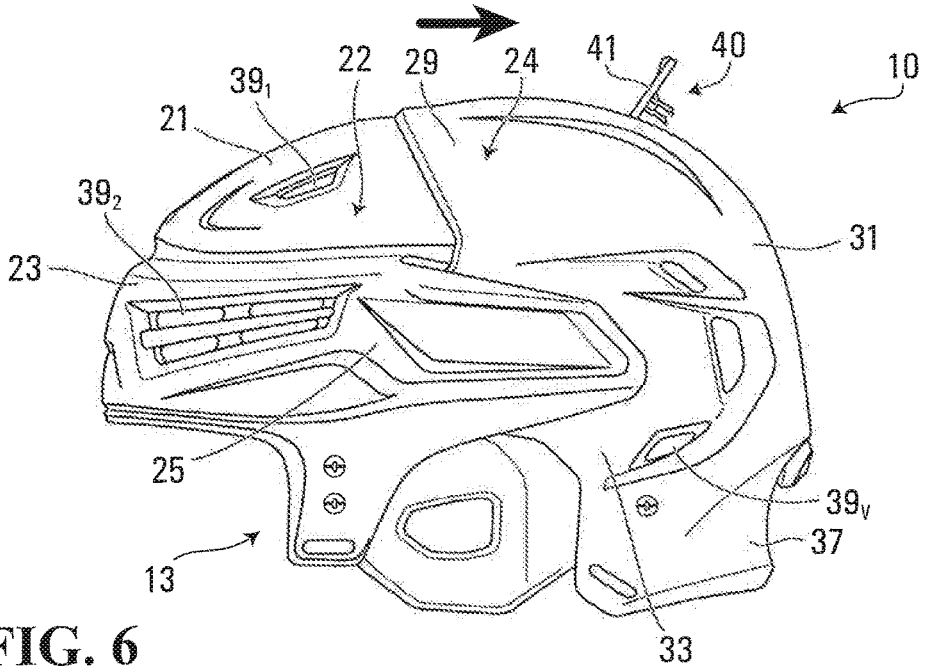
Figure 7:
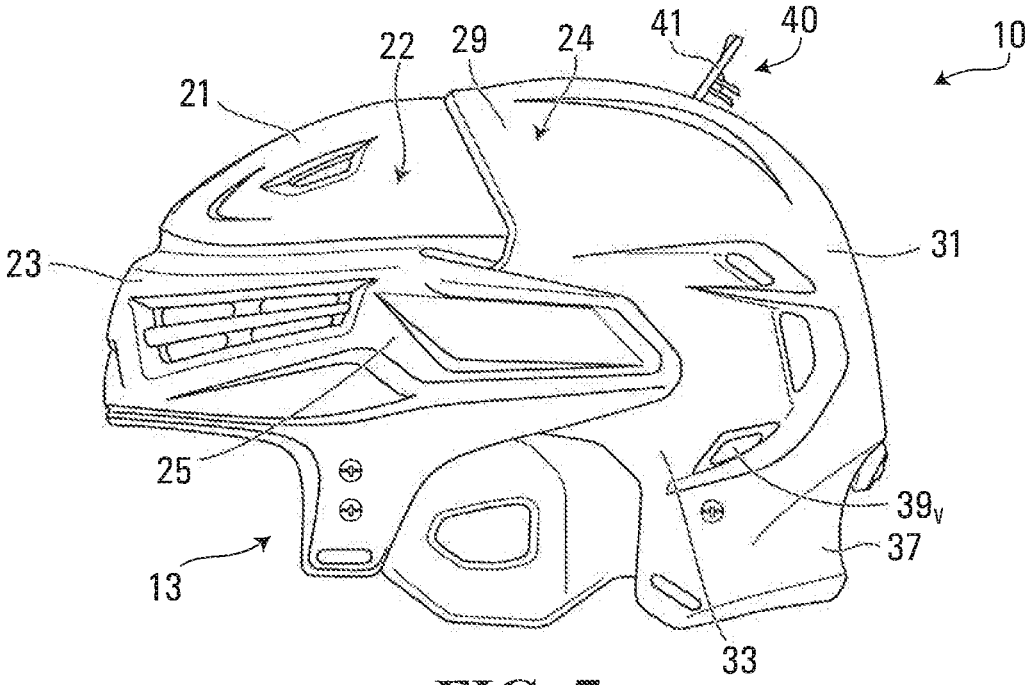
Figure 8:
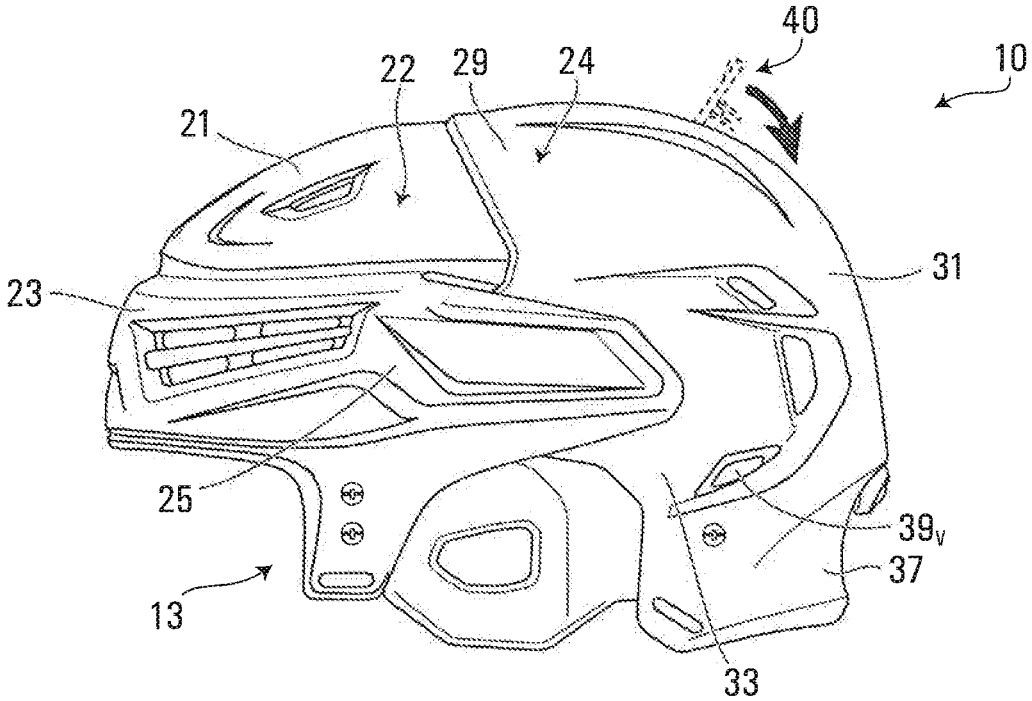

More particularly, in this embodiment, the outer shell 12 and the inner padding 15 are adjustable to adjust the fit of the helmet 10 on the wearer's head 11. To that end, in this case, the front outer shell member 22 and the rear outer shell member 24 are movable relative to one another to adjust the fit of the helmet 10 on the wearer's head 11. The adjustment mechanism 40 is connected between the front outer shell member 22 and the rear outer shell member 24 to enable adjustment of the fit of the helmet 10 by moving the outer shell members 22, 24 relative to one another. In this example, relative movement of the outer shell members 22, 24 for adjustment purposes is in the front-back direction of the helmet 10 such that the front-back internal dimension FBD of the cavity 13 of the helmet 10 is adjusted. This is shown in FIGS. 5 to 8 in which the rear outer shell member 24 is moved relative to the front outer shell member 22 from a first position, which is shown in FIG. 5 and which corresponds to a minimum size of the helmet 10, to a second position, which is shown in FIG. 6 and which corresponds to an intermediate size of the helmet 10, and to a third position, which is shown in FIGS. 7 and 8 and which corresponds to a maximum size of the helmet 10.

Figure 9:
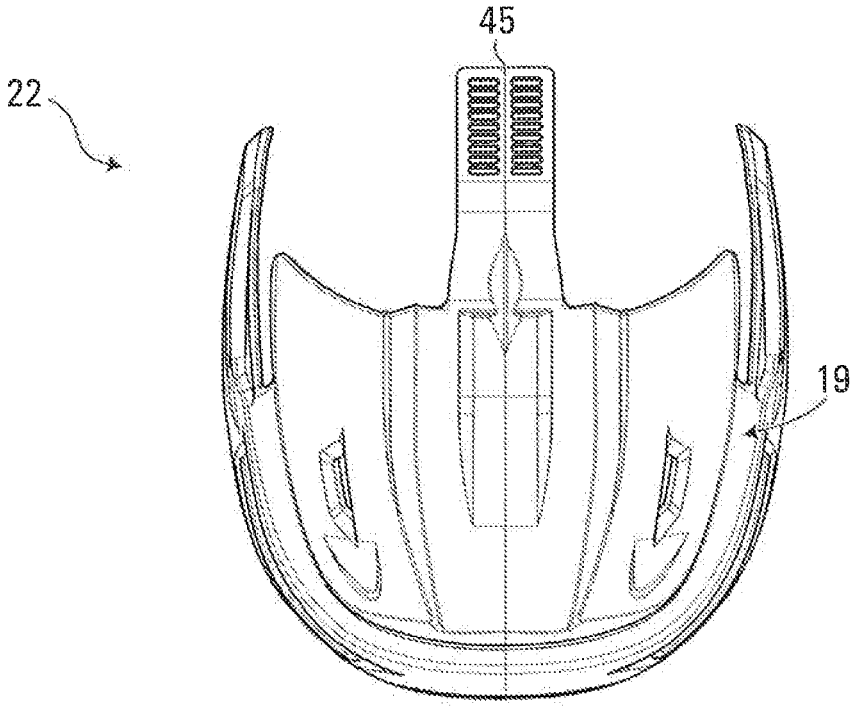
FIGS. 9 and 10 show an example of shell members of an outer shell of the helmet.
Figure 10:
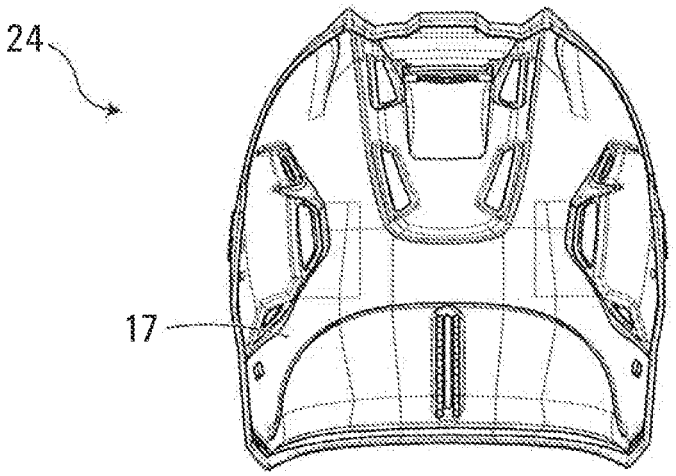

In this example of implementation, the adjustment mechanism 40 comprises an actuator 41 that can be moved (in this case pivoted) by the wearer between a locked position, in which the actuator 41 engages a locking part 45 (as best shown in FIGS. 9 and 10) of the front outer shell member 22 and thereby locks the outer shell members 22, 24 relative to one another, and a release position, in which the actuator 41 is disengaged from the locking part 45 of the front outer shell member 22 and thereby permits the outer shell members 22, 24 to move relative to one another so as to adjust the size of the helmet 10. The adjustment mechanism 40 may be implemented in various other ways in other embodiments.

In this embodiment, the outer shell 12 comprises a plurality of ventilation holes $\mathbf{39}_1$-$\mathbf{39}_V$ allowing air to circulate around the wearer's head 11 for added comfort. In this case, each of the front and rear outer shell members 22, 24 defines respective ones of the ventilation holes $\mathbf{39}_1$-$\mathbf{39}_V$ of the outer shell 12.

The outer shell 12 may be implemented in various other ways in other embodiments. For example, in other embodiments, the outer shell 12 may be a single-piece shell. In such embodiments, the adjustment mechanism 40 may comprise an internal adjustment device located within the helmet 10 and having a head-facing surface movable relative to the wearer's head 11 in order to adjust the fit of the helmet 10. For instance, in some cases, the internal adjustment device may comprise an internal pad member movable relative to the wearer's head 11 or an inflatable member which can be inflated so that its surface can be moved closer to or further from the wearer's head 11 to adjust the fit.

As shown in FIGS. 16 to 18B, the inner padding 15 is disposed between the outer shell 12 and the wearer's head 11 in use to absorb impact energy when the helmet 10 is impacted. More particularly, the inner padding 15 comprises a shock-absorbing structure 32 that includes an outer surface 38 facing towards the outer shell 12 and an inner surface 34 facing towards the wearer's head 11. The shock-absorbing structure 32 comprises a plurality of pads $\mathbf{36}_1$-$\mathbf{36}_N$ to absorb impact energy. The pads $\mathbf{36}_1$-$\mathbf{36}_N$ are responsible for absorbing at least a bulk of the impact energy transmitted to the inner padding 15 when the helmet 10 is impacted and can therefore be referred to as "absorption" pads.

For example, in this embodiment, each of the pads $\mathbf{36}_1$-$\mathbf{36}_N$ comprises a shock-absorbing material 50. For instance, in some cases, the shock-absorbing material 50 may include a polymeric cellular material, such as a polymeric foam (e.g., expanded polypropylene (EPP) foam, expanded polyethylene (EPE) foam, vinyl nitrile (VN) foam, polyurethane foam (e.g., PORON XRD foam commercialized by Rogers Corporation), or any other suitable polymeric foam material), or expanded polymeric microspheres (e.g., Expancel™ microspheres commercialized by Akzo Nobel). In some cases, the shock-absorbing material 50 may include an elastomeric material (e.g., a rubber such as styrene-butadiene rubber or any other suitable rubber; a polyurethane elastomer such as thermoplastic polyurethane (TPU); any other thermoplastic elastomer; etc.). In some cases, the shock-absorbing material 50 may include a fluid (e.g., a liquid or a gas), which may be contained within a container (e.g., a flexible bag, pouch or other envelope) or implemented as a gel (e.g., a polyurethane gel). Any other material with suitable impact energy absorption may be used in other embodiments. In other embodiments, a given one of the pads $\mathbf{36}_1$-$\mathbf{36}_N$ may comprise an arrangement (e.g., an array) of shock absorbers that are configured to deform when the helmet 10 is impacted. For instance, in some cases, the arrangement of shock absorbers may include an array of compressible cells that can compress when the helmet 10 is impacted. Examples of this are described in U.S. Pat. No. 7,677,538 and U.S. Patent Application Publication 2010/0258988, which are incorporated by reference herein.

In some embodiments, the shock-absorbing material 50 of different ones of the pads $\mathbf{36}_1$-$\mathbf{36}_N$ may be different. For instance, in some embodiments, the shock-absorbing material 50 of two, three, four or more the pads $\mathbf{36}_1$-$\mathbf{36}_N$ may be different. For example, in some embodiments, the shock-absorbing material 50 of a pad $\mathbf{36}_i$ may be different from the shock-absorbing material 50 of another pad $\mathbf{36}_j$. For instance, in some cases, the shock-absorbing material 50 of the pad $\mathbf{36}_i$ may be denser than the shock-absorbing material 50 of the pad $\mathbf{36}_j$. Alternatively or additionally, in some cases, the shock-absorbing material 50 of the pad $\mathbf{36}_i$ may be stiffer than the shock-absorbing material 50 of the pad $\mathbf{36}_j$. Combinations of different densities, thickness and type of material for the pads $\mathbf{36}_1$-$\mathbf{36}_N$ may permit for better absorption of high- and low-energy impacts.

The absorption pads $\mathbf{36}_1$-$\mathbf{36}_N$ may be present in any suitable number. For example, in some embodiments, the plurality of absorption pads $\mathbf{36}_1$-$\mathbf{36}_N$ may include at least three pads, in some cases at least five pads, in some cases at least eight pads, and in some cases even more pads (e.g., at least ten pads or more).

In addition to the absorption pads $\mathbf{36}_1$-$\mathbf{36}_N$, in this embodiment, the inner padding 15 comprises comfort pads $\mathbf{64}_1$-$\mathbf{64}_K$ which are configured to provide comfort to the wearer's head. In this embodiment, when the helmet 10 is worn, the comfort pads $\mathbf{64}_1$-$\mathbf{64}_K$ are disposed between the absorption pads $\mathbf{36}_1$-$\mathbf{36}_N$ and the wearer's head 11 to contact the wearer's head 11. The comfort pads $\mathbf{64}_1$-$\mathbf{64}_K$ n may comprise any suitable soft material providing comfort to the wearer. For example, in some embodiments, the comfort pads $\mathbf{64}_1$-$\mathbf{64}_K$ may comprise polymeric foam such as polyvinyl chloride (PVC) foam, polyurethane foam (e.g., PORON XRD foam commercialized by Rogers Corporation), vinyl nitrile foam or any other suitable polymeric foam material. In some embodiments, given ones of the comfort pads $\mathbf{64}_1$-$\mathbf{64}_K$ may be secured (e.g., adhered, fastened, etc.) to respective ones of the absorption pads $\mathbf{36}_1$-$\mathbf{36}_N$. In other embodiments, given ones of the comfort pads $\mathbf{64}_1$-$\mathbf{64}_K$ may be mounted such that they are movable relative to the absorption pads $\mathbf{36}_1$-$\mathbf{36}_N$. For example, in some embodiments, given ones of the comfort pads $\mathbf{64}_1$-$\mathbf{64}_K$ may be part of a floating liner as described in U.S. Patent Application Publication 2013/0025032, which, for instance, may be implemented as the SUSPEND-TECH™ liner found in the BAUER™ RE-AKT™ and RE-AKT 100™ helmets made available by Bauer Hockey, Inc. The comfort pads $\mathbf{64}_1$-$\mathbf{64}_K$ may assist in absorption of energy from impacts, in particular, low-energy impacts.

The absorption pads $\mathbf{36}_1$-$\mathbf{36}_N$ are configured to move relative to one another in response to an impact on the helmet 10. This may enhance protection. Notably, in response to a rotational impact on the helmet 10, the pads $\mathbf{36}_1$-$\mathbf{36}_N$ can move relative to one another, thus absorbing rotational energy from the rotational impact and reducing angular acceleration of the wearer's head 11.

In this embodiment, the inner padding 15 comprises a frame 60 carrying the pads $\mathbf{36}_1$-$\mathbf{36}_N$ and configured to allow the pads $\mathbf{36}_1$-$\mathbf{36}_N$ to move relative to one another in response to an impact on the helmet 10. In particular, in this embodiment, the frame 60 is disposed between the outer shell 12 and the pads $\mathbf{36}_1$-$\mathbf{36}_N$. More particularly, in this embodiment, the frame 60 comprises a plurality of frame members $63_1$-$63_F$ carrying respective ones of the pads $36_1$-$36_N$ and configured to move relative to one another in response to an impact on the helmet 10. More specifically, in this embodiment, the frame members $63_1$-$63_F$ are arranged into a network and respective ones of the pads $36_1$-$36_N$ are attached at nodes $46_1$-$46_G$ of the network. The plurality of frame members $63_1$-$63_F$ comprises a plurality of pad supports $46_1$-$46_G$ to which the respective ones of the pads $36_1$-$36_N$ are attached and a plurality of links $47_1$-$47_H$ interconnecting the pad supports $46_1$-$46_G$. In other words, in this embodiment, each of the pads $36_1$-$36_N$ is separately attached to the frame 60 at a respective one of multiple attachment points. In this example of implementation, each of the links $47_1$-$47_H$ is elongated. In this case, given ones of the links $47_1$-$47_H$ are curved. In this embodiment, each of the pad supports $46_1$-$46_G$ is located where respective ones of the links $47_1$-$47_H$ intersect. In some cases, a given one of the pad supports $46_1$-$46_G$ may be located where at least three of the links $47_1$-$47_H$ intersect. Each of the pad supports $46_1$-$46_G$ comprises an enlargement 51 where the respective ones of the links $46_1$-$46_G$ intersect.

In this embodiment, the frame 60 is deformable (i.e., changeable in configuration) to allow the pads $36_1$-$36_N$ to move relative to one another in response to the impact on the helmet 10. More particularly, in this embodiment, the frame 60 comprises a material 61 that allow deformation of the frame 60. The frame 60 may be resilient to allow the frame 60 to return to an original configuration after the frame 60 is bent, compressed, stretched or otherwise deformed into a different configuration in response to the impact on the helmet 10.

For example, in some embodiments, the material 61 of the frame 60 may have an elastic modulus (i.e., Young's modulus) of no more than 150 GPa in some cases no more than 100 GPa, in some cases no more than 50 GPa, in some cases no more than 25 GPa, in some cases no more than 10 GPa, in some cases no more than 5 GPa, in some cases no more than 1 GPa, in some cases no more than 0.1 GPa, and in some cases even less.

For instance, in some embodiments, the material 61 of the frame 60 may comprise a thermoplastic material, nylon, polycarbonate, acrylonitrile butadiene styrene (ABS), polyamide (PA), glass or carbon reinforced polypropylene (PP), and/or any other suitable material. Examples of suitable thermoplastic materials include rubber, high density VN foam, high density PE foam.

In this embodiment, the frame 60 is thinner than a given one of the pads $36_1$-$36_N$. For example, in some embodiments, a ratio of a thickness of the frame 60 over a thickness of the given one of the pads $36_1$-$36_N$ may be no more than 0.5, in some cases no more than 0.3, in some cases no more than 0.1, and in some cases even less.

The thickness of the pads $36_1$-$36_N$ may be constant or vary. For instance, the thickness of a given one of the pads $36_1$-$36_N$ may be constant or variable and/or the thickness of the pads $36_1$-$36_N$ may be constant or variable over multiple ones of the pads $36_1$-$36_N$. In particular, in some embodiments, the thickness of a first one of the pads $36_1$-$36_N$ may be different from and the thickness of a second one of the pads $36_1$-$36_N$.

The frame 60 may be mounted within the helmet 10 in any suitable way. In this embodiment, the frame 60 is connected to the outer shell 12. For instance, in this embodiment, the frame 60 includes a plurality of connectors $73_1$-$73_p$ for connecting the frame 60 to the outer shell 12. In this example, the connectors $73_1$-$73_p$ include apertures in the frame 60 which receive fasteners (e.g., screws, bolts, etc.) to connect the frame 60 to the outer shell 12. In other examples, the connectors $73_1$-$73_p$ may comprise projections of the frame 60 that are received in openings of the outer shell 12.

In this embodiment, the frame 60 is connected to a remainder of the helmet 10 in a lower edge region 14 of the helmet 10. The frame 60 may be unconnected to the remainder of the helmet 10 over a substantial part of a height $H_f$ of the frame 60. For instance, in some examples of implementation, the frame 60 may be unconnected to the remainder of the helmet 10 from an apex 55 of the frame 60 downwardly for at least one-quarter of the height $H_f$ of the frame 60, in some cases for at least one-third of the height $H_f$ of the frame 60, and in some cases for at least half of the height $H_f$ of the frame 60. In some embodiments, the frame 60 may connected to the remainder of the helmet 10 only in a bottom third of the height $H_f$ of the frame 60, in some cases only in a bottom quarter of the height $H_f$ of the frame 60, and in some cases only in a bottom fifth of the height $H_f$ of the frame 60.

Different ones of the pads $36_1$-$36_N$ are movable relative to one another in respect to an impact. In this embodiment, a given one of the pads $36_1$-$36_N$ is omnidirectionally movable (i.e., is movable in any direction) relative to another one of the pads $36_1$-$36_N$ in response to an impact.

A range of motion of a first one of the pads $36_1$-$36_N$ relative to a second one of the pads $36_1$-$36_N$ in response to the impact on the helmet 10 may be characterized in any suitable way in various embodiments.

For example, in some embodiments, the range of motion of the first one of the pads $36_1$-$36_N$ relative to the second one of the pads $36_1$-$36_N$ in response to the impact on the helmet 10 may correspond to at least 1% of the length L of the helmet 10, in some cases at least 3% of the length L of the helmet 10, in some cases at least 5% of the length L of the helmet 10, and in some cases even more. As another example, in some embodiments, the range of motion of the first one of the pads $36_1$-$36_N$ relative to the second one of the pads $36_1$-$36_N$ in response to the impact on the helmet 10 may correspond to at least 0.5% of the width W of the helmet 10, in some cases at least 1.5% of the width W of the helmet 10, in some cases at least 3% of the width W of the helmet 10, and in some cases even more.

For instance, in some embodiments, the range of motion of the first one of the pads $36_1$-$36_N$ relative to the second one of the pads $36_1$-$36_N$ in response to the impact on the helmet 10 may be at least 2.5 mm, in some cases at least 5 mm, in some cases at least 10 mm, and in some cases even more.

Resistance to deformation of the material 61 of the frame 60 and the geometry of the frame 60 may establish the limit of the displacement of the pads $36_1$-$36_N$.

In this embodiment, the inner padding 15 comprises a filler 58 disposed between the frame 60 and the inner surface 17 of the outer shell 12. More particularly, in this embodiment, the filler 58 comprises a plurality of filling pads $59_1$-$59_L$ adjacent to one another. As such, the filler 58 may have a variable thickness to create a homogeneous interface with the inner surface 17 of the outer shell 12. Thus, in this case, the filling pads $59_1$-$59_L$ may be of variable thicknesses. In some examples of implementation, the filler 58 comprises foam. In other examples of implementation, the filler 58 may comprise any suitable material (e.g., elastomeric material or any lightweight solid material such as EPP, EPE, Expancel, VN and PE foams). The pads $36_1$-$36_N$ are dimensioned to substantially cover an inner surface of the filler 58.

In other embodiments, the filler 58 may be omitted. For instance, in some embodiments, the frame 60 may directly interface with the inner surface 17 of the outer shell 12 and the pads $36_1$-$36_N$ may be dimensioned to substantially cover the inner surface 17 of the outer shell 12.

Figure 18A:
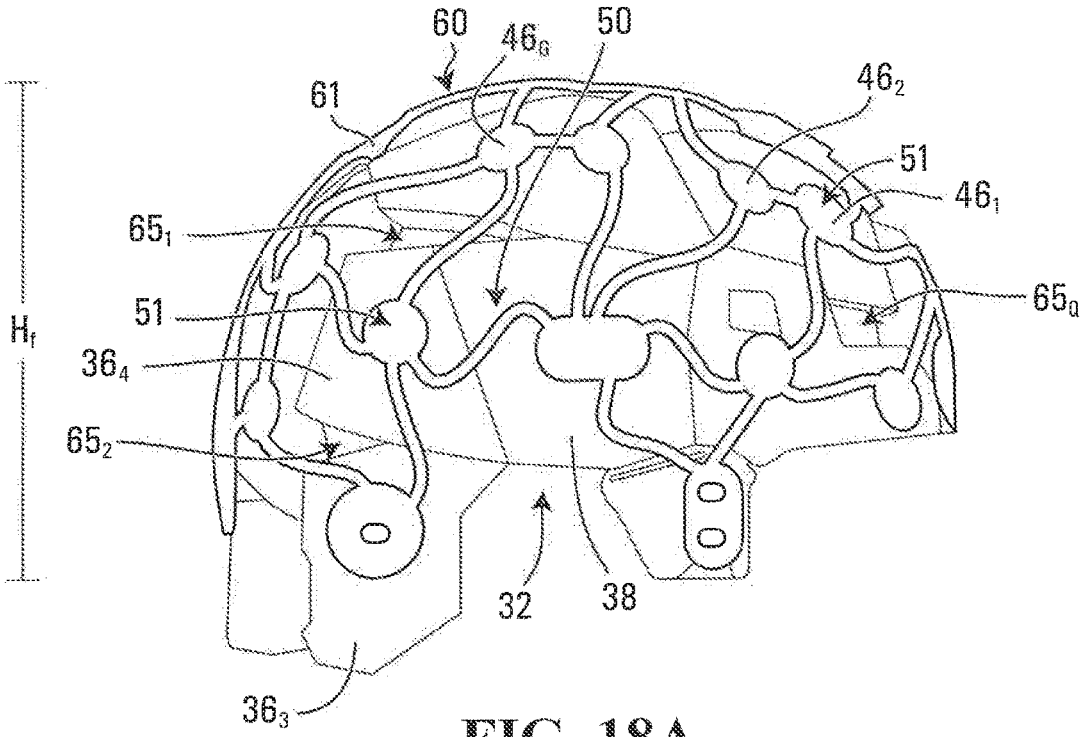
FIGS. 18A and 18B show an example of pads and a frame of the helmet in an open position and a closed position, respectively.
Figure 18B:
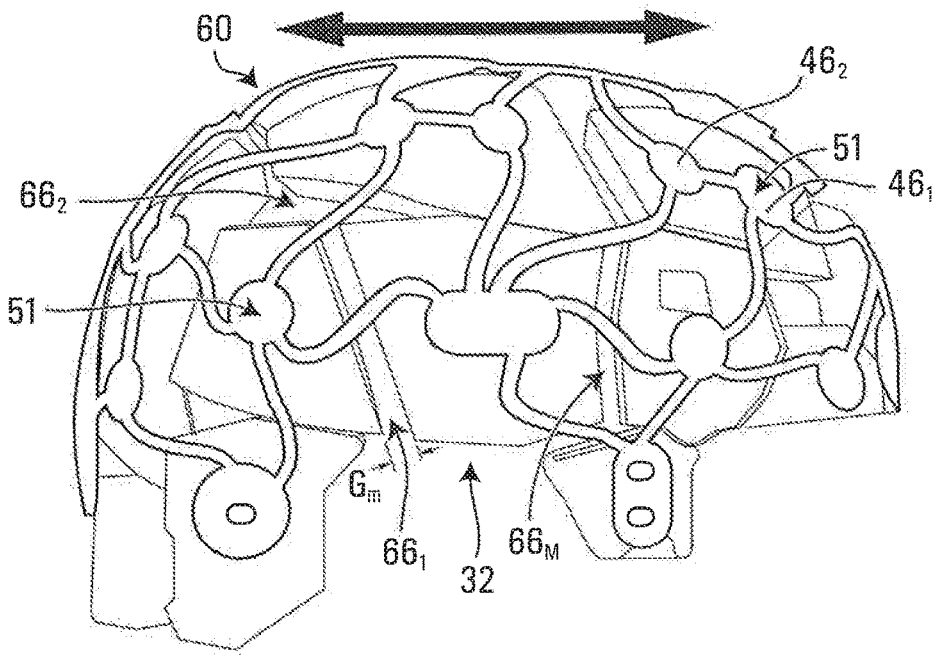
Figure 19:
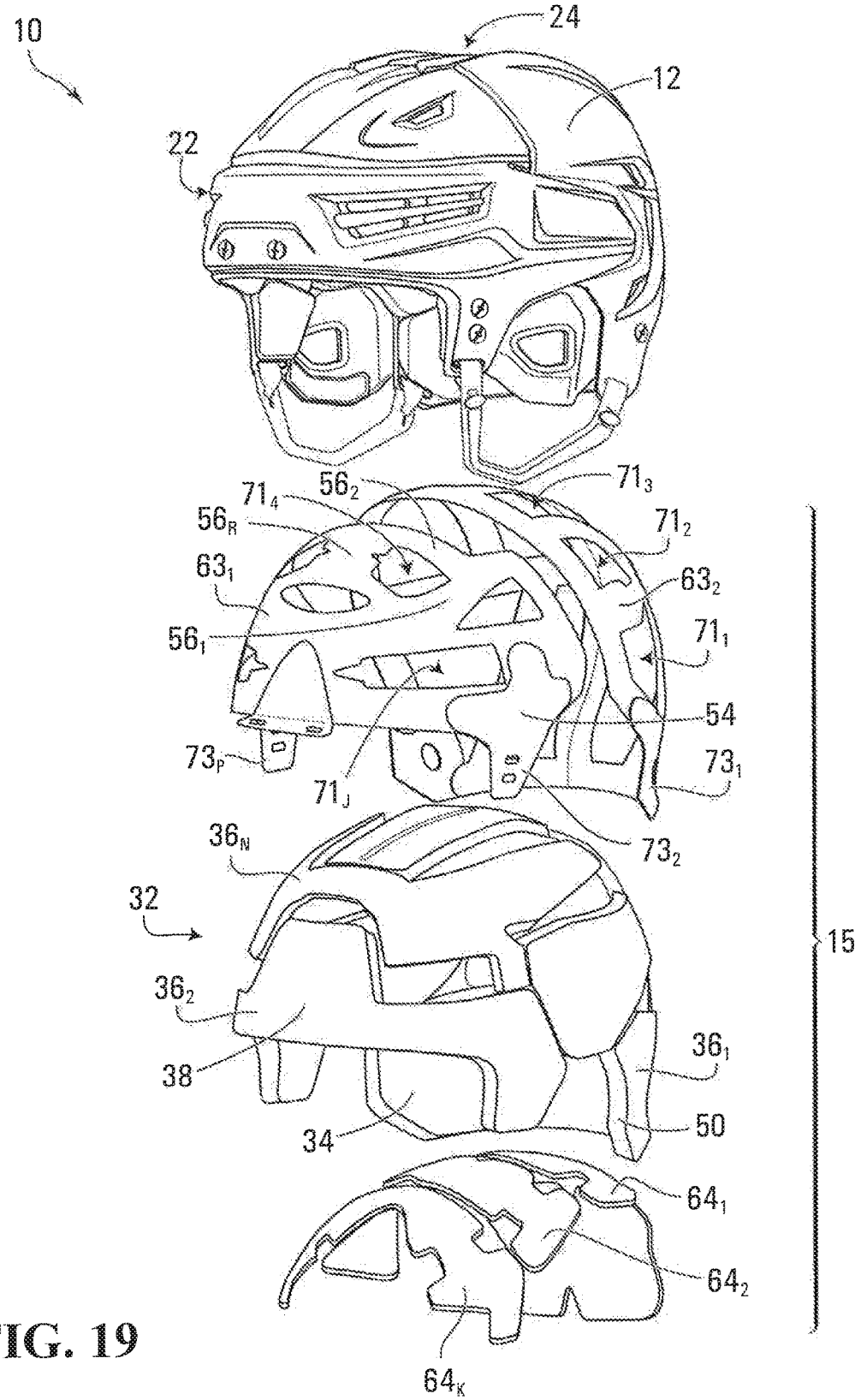
FIG. 19 shows a perspective exploded view of the helmet in accordance with another embodiment of the invention.
Figure 20A:
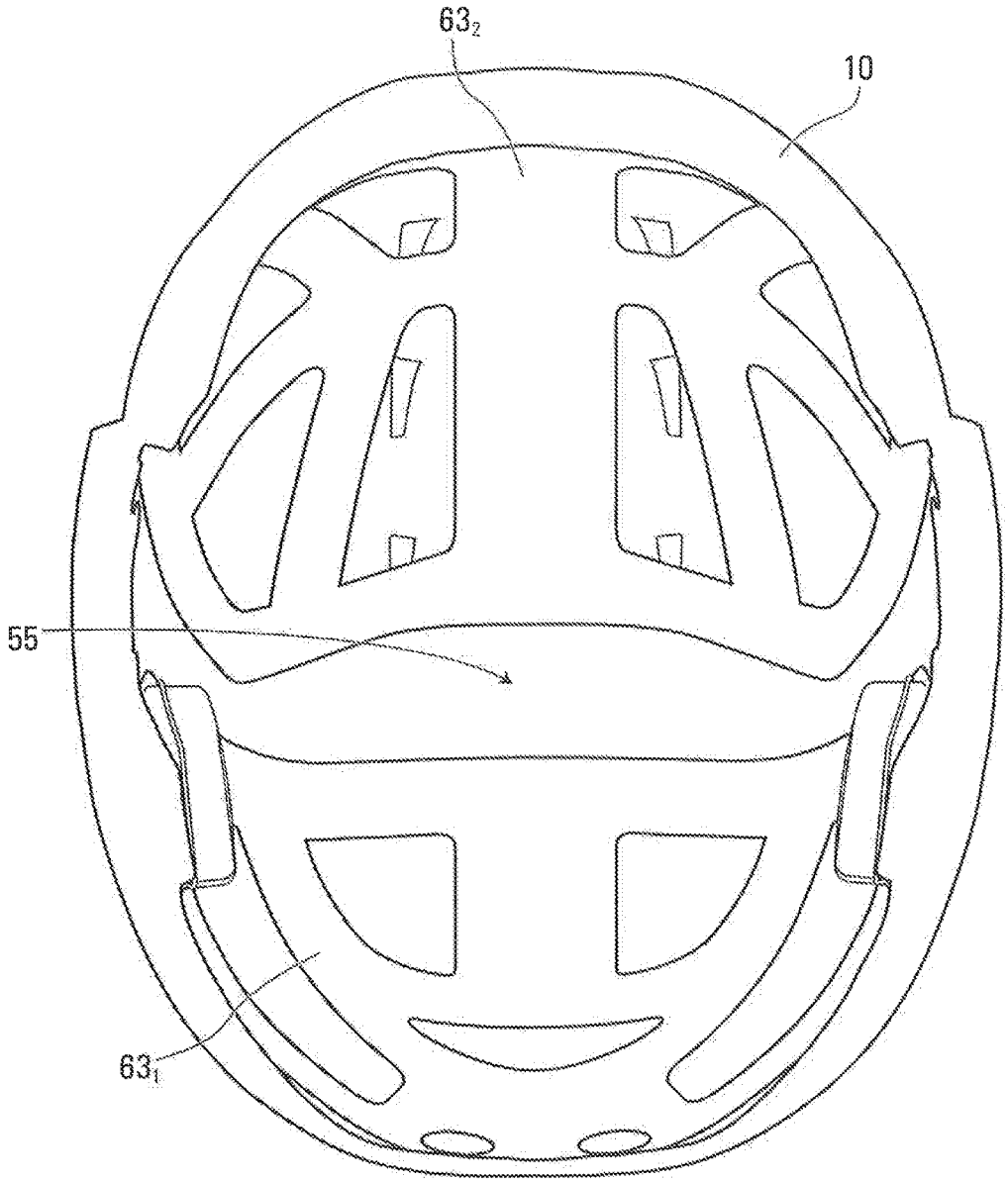
FIGS. 20A, 20B and 20C show inside views of components of the helmet of FIG. 19.
Figure 20B:
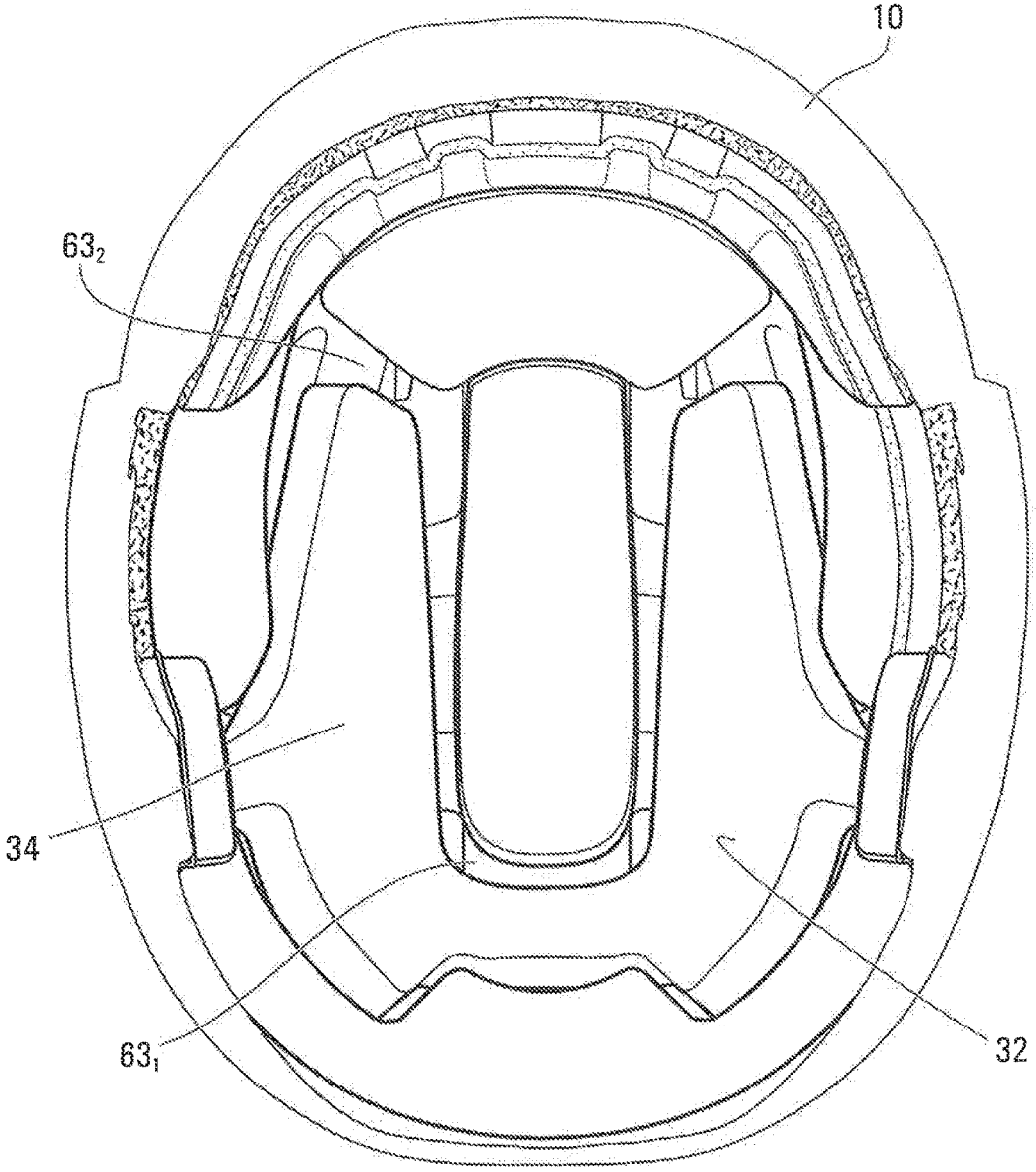
Figure 20C:
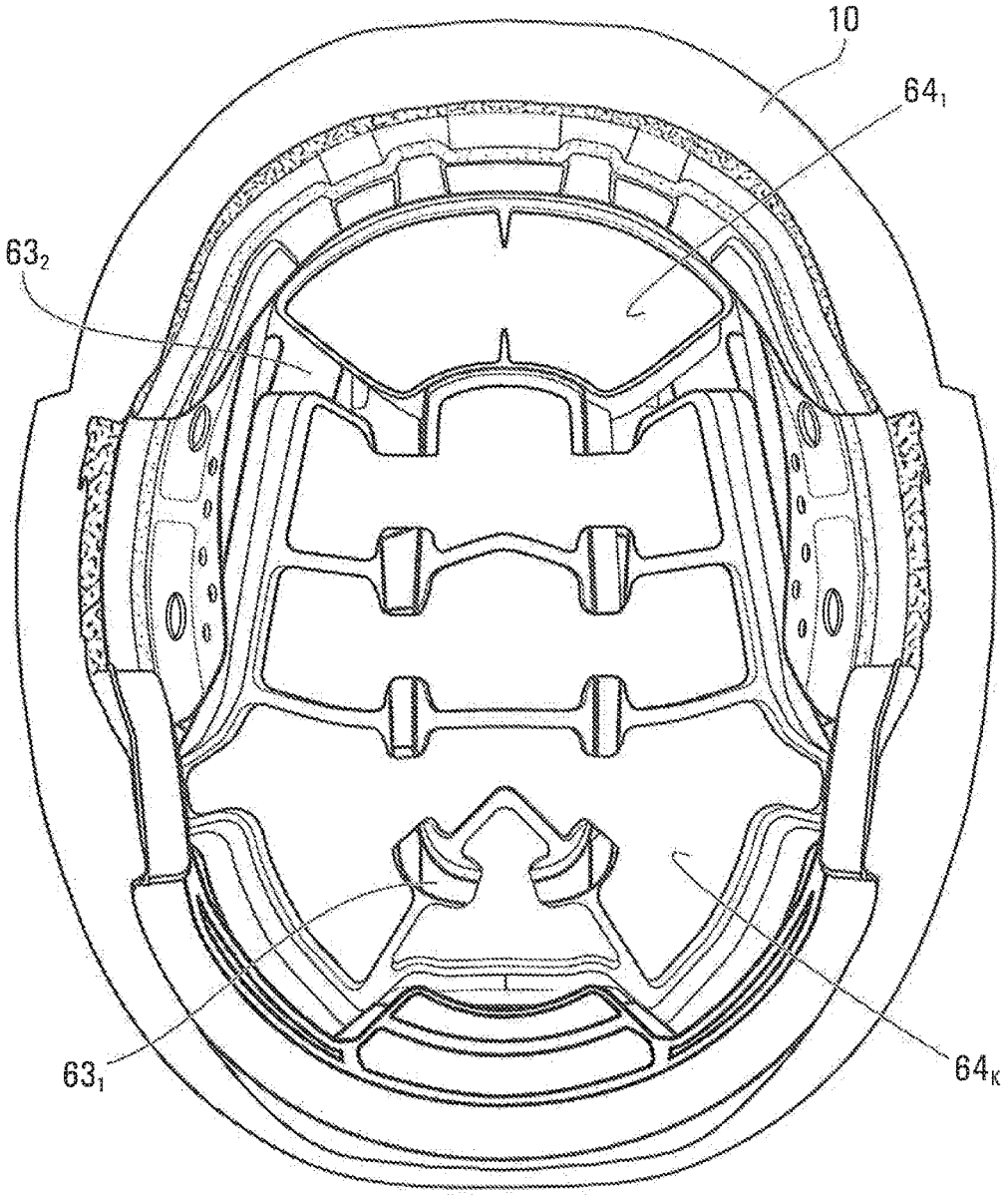

In this example of implementation where the helmet 10 includes the adjustment mechanism 40 to adjust the fit of the helmet 10 on the wearer's head 11, in some embodiments, when the adjustment mechanism 40 is operated to set a maximal size of the helmet 10, a maximal gap $G_m$ between adjacent ones of the pads $36_1$-$36_N$ may be no more than 10% of the length L of the helmet 10, in some cases no more than 5% of the length L of the helmet 10, in some cases no more than 3% of the length L of the helmet 10, and in some cases even less. With reference to FIG. 18B, the maximal gap $G_m$ between adjacent ones of the pads $36_1$-$36_N$ can be defined as the maximum distance of gaps $66_1$-$66_M$ between adjacent ones of the pads $36_1$-$36_N$ when the adjustment mechanism 40 is operated to set the maximal size of the helmet 10. For instance, in some embodiments, when the adjustment mechanism 40 is operated to set the maximal size of the helmet 10, the maximal gap $G_m$ between adjacent ones of the pads $36_1$-$36_N$ may be no more than 20 mm, in some cases no more than 10 mm, in some cases no more than 5 mm, and in some cases even less.

In this embodiment, the configuration of the pads $36_1$-$36_N$ may thus permit some displacement, in all directions, of one or more of the pads $36_1$-$36_N$ in response to an impact such as a rotational impact. With reference to FIGS. 18A and 18B, the frame 60 and the pads $36_1$-$36_N$ may reduce the size of the maximal gap $G_m$ between adjacent ones of the pads $36_1$-$36_N$ when the adjustment mechanism 40 is operated to set the maximal size of the helmet 10 in comparison to conventional adjustable helmets. In particular, FIG. 18A shows the helmet 10 is in a closed position, that corresponds to the minimum size of the helmet 10, and where there are substantially no gaps between adjacent ones of the pads $36_i$-$36_N$; although, FIG. 18A does show some gaps $65_1$-$65_Q$, these gaps $65_1$-$65_Q$ are typically less than the maximal gap $G_m$. Moreover, FIG. 18B shows the helmet 10 is in an open position, that corresponds to the maximum size of the helmet 10, and where there are gaps $66_1$-$66_M$ between adjacent ones of the pads $36_1$-$36_N$. Conventional adjustable helmets may have weaker absorption points as opening of the conventional adjustable helmets may create gaps on the side and on the top of the helmet where there is no absorption lining or foam. In this case, with the use of the frame 60 and the pads $36_1$-$36_N$, the gaps $66_1$-$66_M$ are generally divided between adjacent ones of the pads $36_1$-$36_N$ and the gaps $66_1$-$66_M$ are typically less than the gaps created in conventional adjustable helmets.

The helmet 10, including the frame 60 and the pads $36_1$-$36_N$ that are movable relative to one another, may be implemented in any other suitable way in other embodiments.

For example, in other embodiments, as shown in FIGS. 19 to 22, the helmet 10 comprises the absorption pads $36_1$-$36_N$, the frame 60 carrying the absorption pads $36_1$-$36_N$, and the comfort pads $64_1$-$64_K$ according to a variant.

In this embodiment, the plurality of frame members $63_1$-$63_F$ of the frame 60 includes a front frame member $63_1$ and a rear frame member $63_2$. In contrast to previous embodiments, in this example, the frame members $63_1$-$63_F$ are separate pieces instead of being interconnected to form a network. Although in this embodiment the plurality of frame members $63_1$-$63_F$ consists of two separate frame members $63_1$ $63_2$, in other embodiments the plurality of frame members $63_1$-$63_F$ may be more than two member.

In this embodiment, the front frame member $63_1$ extends in a front part of the helmet 10 and carries front ones of the pads $36_1$-$36_N$ and the rear frame member $63_2$ extends in a rear part of the helmet and carries rear ones of the pads $36_1$-$36_N$. That is, in this embodiment, the front frame member $63_1$ carries a first set of one or more of the pads $36_1$-$36_N$ and the rear frame member $63_2$ carries a second set of one or more of the pads $36_1$-$36_N$ where the pads in each of the first set and the second set are separate pads. In this example, each of the pads $36_1$-$36_N$ is attached either to the front frame member $63_1$ or to the rear frame member $63_2$ but not to both of the front frame member $63_1$ and to the rear frame member $63_2$. That is, each of the pads $36_1$-$36_N$ is attached to a given one of the front frame member $63_1$ and to the rear frame member $63_2$ and is not attached to the other one of the front frame member $63_1$ and the rear frame member $63_2$. Each of the pads $36_1$-$36_N$ may be attached to a respective one of the front frame member $63_1$ and to the rear frame member $63_2$ in any suitable way (e.g., by an adhesive, by a fastener such as a screw, etc.).

More particularly, in this embodiment, the front frame member $63_1$ overlies at least part of the front region FR, the top region TR, and the left and right side regions LS, RS of the wearer's head 11, while the rear frame member $63_2$ overlies at least part of the back region BR of the wearer's head 11 when the helmet 10 is worn. Each of the front frame member $63_1$ and the rear frame member $63_2$ includes a plurality of openings $71_1$-$71_J$. This may facilitate deformation (i.e., change in configuration) of portions $56_1$-$56_R$ of each of the front frame member $63_1$ and the rear frame member $63_2$ defined between the openings $71_1$-$71_J$ in response to an impact to allow movement of the pads $36_i$-$36_N$. The frame 60, notably the front frame member $63_1$ and the rear frame member $63_2$, may be molded in foam or in pieces of flat molded thermoplastic and assembled to provide the frame 60.

In this embodiment, the inner padding 15 includes a plurality of connectors $73_1$-$73_p$ connecting the frame 60 to the outer shell 12. In this embodiment, the connectors $73_1$-$73_p$ are deformable (i.e., changeable in configuration) to allow the front frame member $63_1$ and the rear frame member $63_2$ and thus the pads $36_1$-$36_N$ to move relative to one another in response to an impact on the helmet. In this case, each of the connectors $73_1$-$73_p$ is elastically stretchable to allow the pads $36_1$-$36_N$ to move relative to one another in response to the impact on the helmet 10.

More particularly, in this embodiment, each connector $73_l$ comprises a material 54 that allows deformation of the connector $73_l$ in response to an impact on the helmet 10. The connector $73_l$ may be resilient to allow the connector $73_l$ to return to an original configuration after the connector $73_l$ is bent, compressed, stretched or otherwise deformed into a different configuration in response to the impact on the helmet 10.

For example, in some embodiments, the material 54 of the connector $73_l$ may have an elastic modulus (i.e., Young's modulus) of no more than 0.1 GPa, in some cases no more than 0.05 GPa, in some cases no more than 0.01 GPa, and in some cases even less. It is appreciated that the elastic module may vary depending on the range of the type of material 54 used for the connector material $73_l$ in various embodiments.

For instance, in some embodiments, the material 54 of the connector $73_l$ may be an elastomeric material which may include rubber, thermoplastic elastomer (TPE) (e.g., TPE-U, TPE-S, TPE-E, TPE-A, TPE-O, TPE-V) or any other suitable material.

In this embodiment, therefore, the configuration of the pads $36_1$-$36_N$ permits some displacement, in all directions, of one or more of the pads $36_1$-$36_N$ in response to an impact and, in particular, a rotational impact. Resistance to deformation of the material 54 of the connectors $73_1$-$73_p$ may establish the limit of the displacement of the pads $36_1$-$36_N$.

In this embodiment, the front frame member $63_1$ is connected to the first shell member 22 of the outer shell 12 via respective ones of the connectors $73_1$-$73_p$ and the rear frame member $63_2$ is connected to the second shell member 24 of the outer shell 12 via other ones of the connectors $73_1$-$73_p$. As each of the pads $36_1$-$36_N$ is only attached to one of the front frame member $63_1$ and the rear frame member $63_2$, when the first shell member 22 and the second shell member 24 are moved relative to one another by operating the adjustment mechanism 40, the first set of one or more of the pads $36_1$-$36_N$ which is attached to the front frame member $63_1$ moves relative to the second set of one or more of the pads $36_1$-$36_N$ which is attached to the rear frame member $63_2$.

Figure 21A:
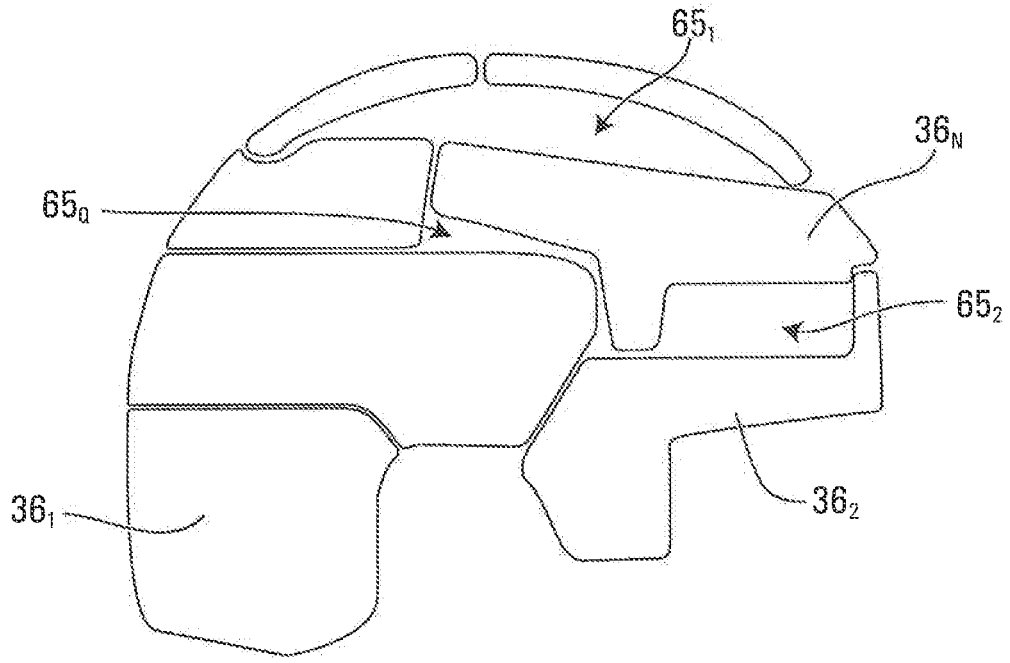
FIGS. 21A and 21B show an example of pads of the helmet of FIG. 19 in an open position and a closed position, respectively.
Figure 21B:
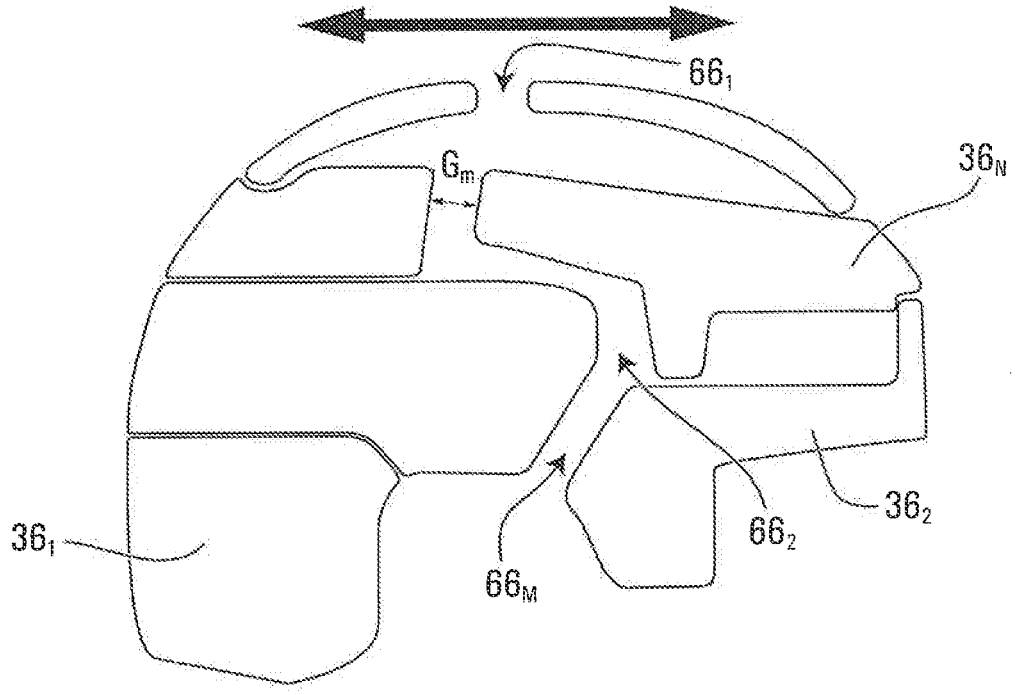
Figure 22:
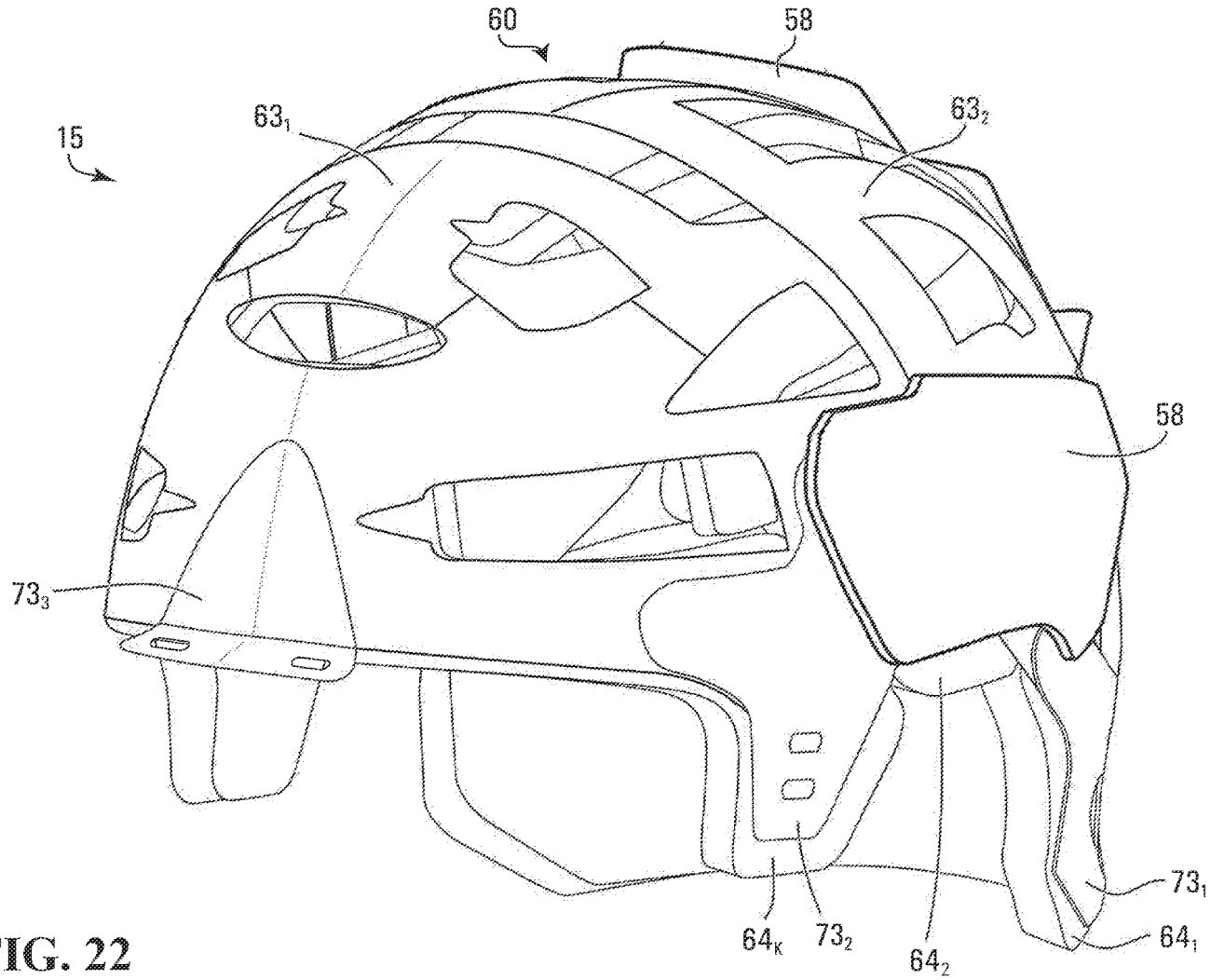
FIG. 22 shows the pads and the frame of the helmet of FIG. 19.

In this embodiment, although each of the pads $36_1$-$36_N$ is only attached to one of the front frame member $63_1$ and the rear frame member $63_2$, select ones of the pads $36_1$-$36_N$ attached to the front frame member $63_1$ may overlap the rear frame member $63_2$. Similarly, select ones of the pads $36_1$-$36_N$ attached to the rear frame member $63_2$ may overlap the front frame member $63_1$. Such an overlapping configuration allows for the maximum gap $G_m$ of the gaps $66_1$-$66_M$ to be a suitable distance in comparison to conventional adjustable helmets. With reference to FIGS. 21A and 21B, the pads $36_1$-$36_N$ may reduce the size of the maximal gap of the gaps $66_1$-$66_M$ between adjacent ones of the pads $36_1$-$36_N$ when the adjustment mechanism 40 is operated to set the maximal size of the helmet 10 in comparison to conventional adjustable helmets. In particular, FIG. 21A shows the helmet 10 is in the closed position, that corresponds to the minimum size of the helmet 10, and where there are existing gaps $65_1$-$65_Q$ between adjacent ones of the pads $36_1$-$36_N$ but which are typically less than the maximal gap. Moreover, FIG. 21B shows the helmet 10 is in the open position, that corresponds to the maximum size of the helmet 10, and where there are gaps $66_1$-$66_M$ between adjacent ones of the pads $36_1$-$36_N$.

The combination of the frame 60, the absorption pads $36_1$-$36_N$ and the comfort pads $64_1$-$64_K$ may thus assist in ensuring that protection is provided against all types of impacts, including, high-energy, low-energy, linear and rotational impacts.

Figure 23:
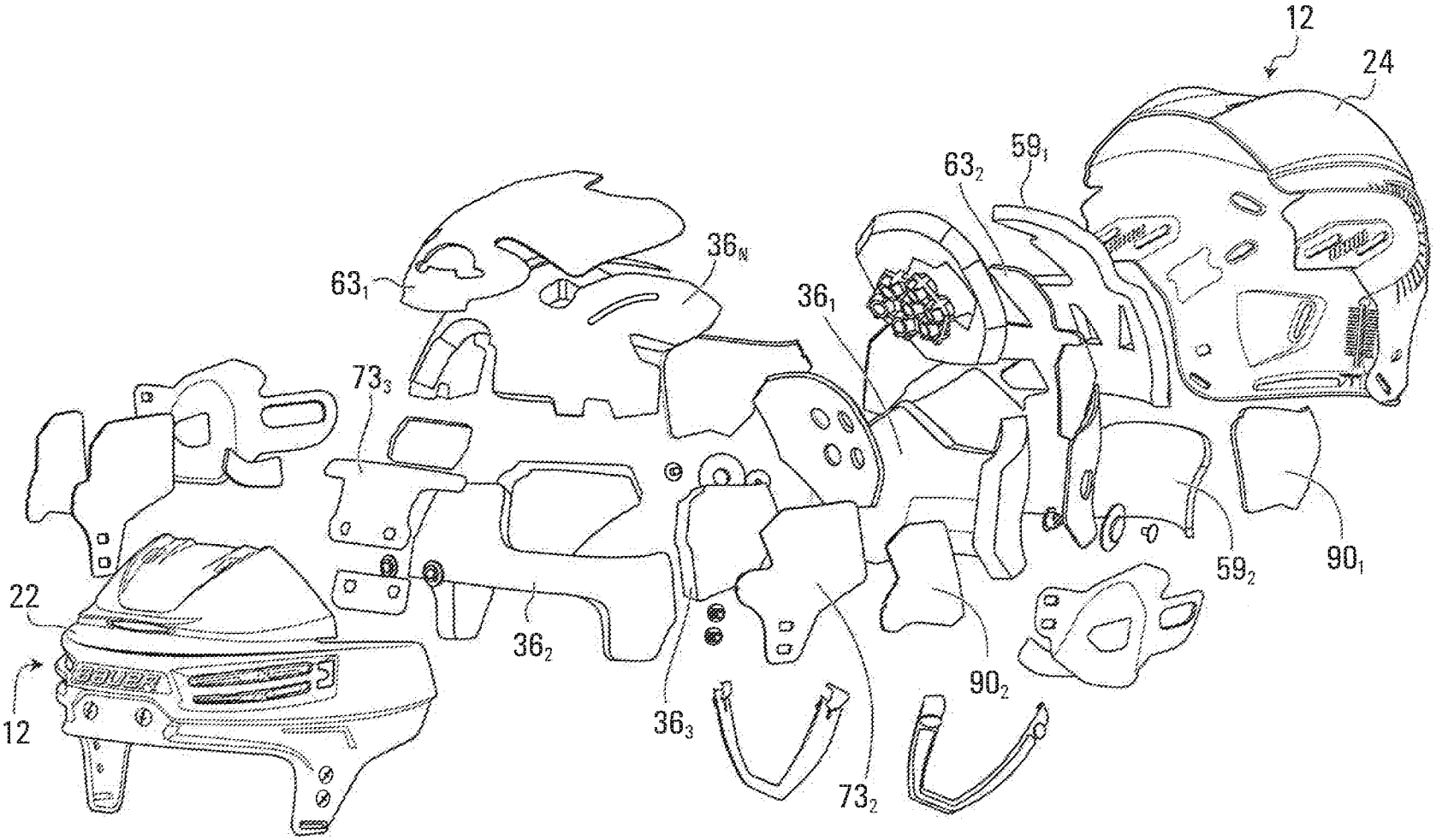
FIG. 23 shows a perspective exploded view of the helmet in accordance with another embodiment of the invention.
Figure 24:
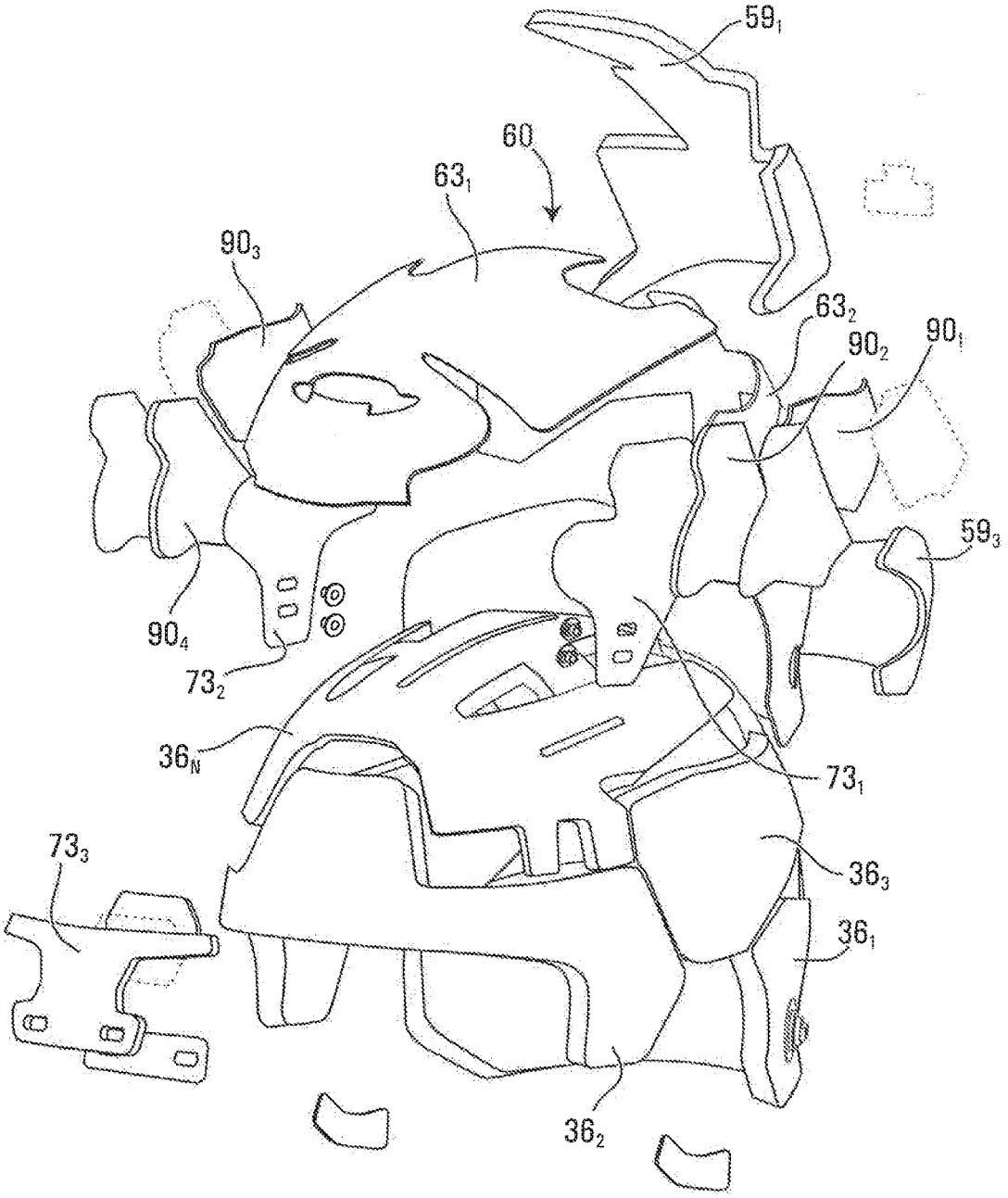
FIG. 24 shows a perspective exploded view of pads and a frame of the helmet of FIG. 23.
Figure 25:
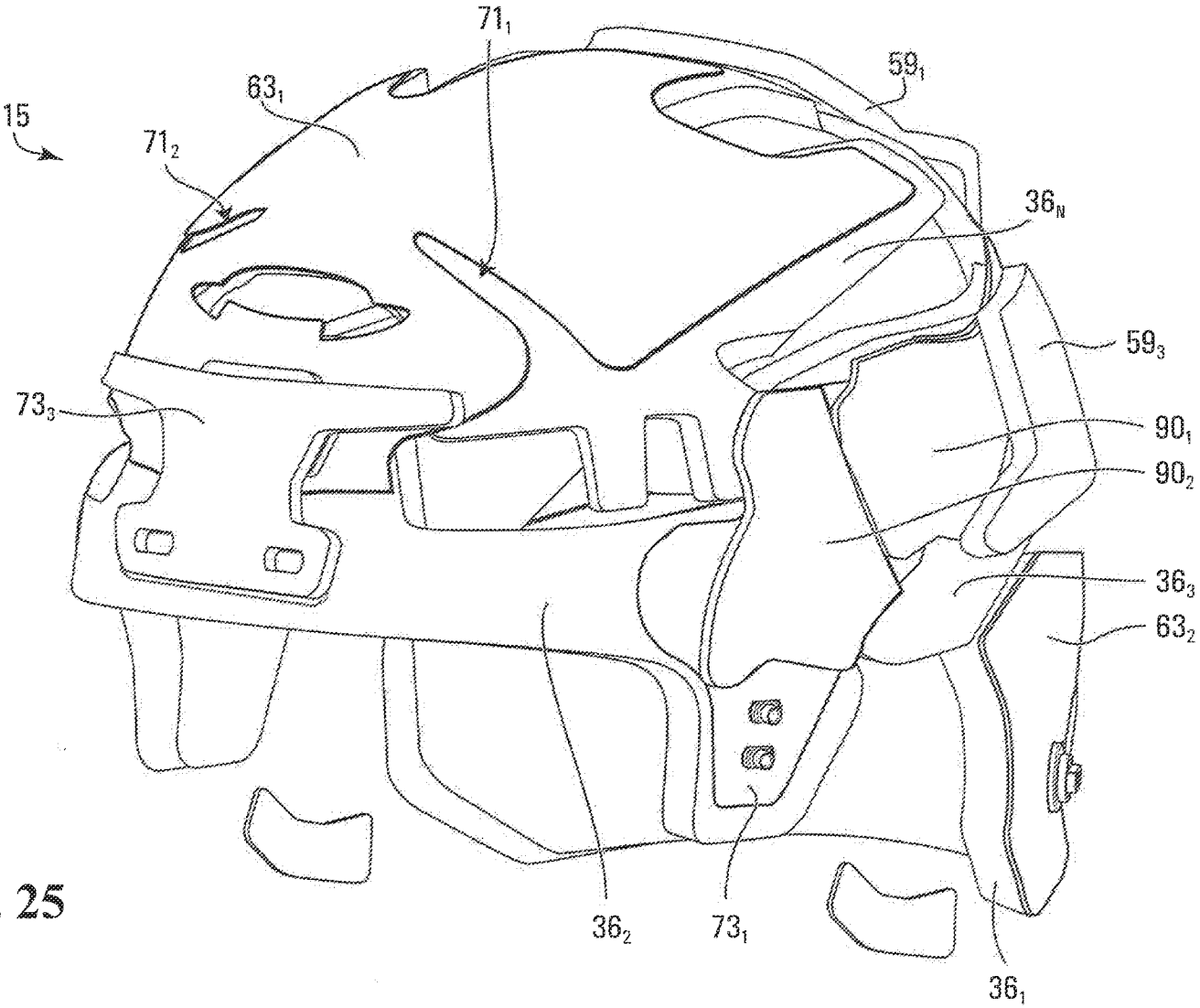
FIG. 25 shows a perspective view of the pads and the frame of the helmet of FIG. 23.

FIGS. 23 to 25 show another embodiment of the helmet 10 that comprises the absorption pads $36_1$-$36_N$, the frame 60 carrying the absorption pads $36_1$-$36_N$, and the comfort pads $64_1$-$64_K$ according to another variant. In this embodiment, given ones of the pads $36_1$-$36_N$ are configured to move relative to one another in response to an impact on the helmet, by virtue of movement of the front frame member $63_1$ and the rear frame member $63_2$. The front frame member $63_1$ is connected to the outer shell 12 by respective ones of the connectors $73_1$-$73_p$. The rear frame member $63_2$ is connected to the outer shell 12 by fastening hardware. In examples of implementation, the rear frame member $63_2$ has holes for receiving the fastening hardware (e.g., screws, bolts, etc.). In this embodiment, the frame 63 is thin and is deformable in response to the impact and the connectors $73_1$-$73_p$ are thin but are not deformable or less deformable than the frame 63. As shown, the front frame member $63_1$ includes openings $71_1$-$71_J$, (e.g. slots) which facilitate deformability of the front frame member $63_1$. Also, the material 61 of the front frame member $63_1$ facilitates deformability of the front frame member $63_1$. In this embodiment, the inner padding 15 comprises a plurality of absorbing pads $90_{1\text{-}C}$ that are fixed to the outside of the frame 63 and are not fixed directly to the outer shell 12. As the pads $90_{1\text{-}C}$ are not fixed to outer shell 12, the pads $90_{1\text{-}C}$ are moveable in respect to the outer shell 12 in response to the impact.

Any feature of any embodiment discussed herein may be combined with any feature of any other embodiment discussed herein in some examples of implementation.

Although in embodiments considered above the helmet 10 is a hockey helmet for protecting the head of a hockey player, in other embodiments, a helmet constructed using principles described herein in respect of the helmet 10 may be another type of sport helmet. For instance, a helmet constructed using principles described herein in respect of the helmet 10 may be for protecting the head of a player of another type of contact sport (sometimes referred to as "full-contact sport" or "collision sport") in which there are significant impact forces on the player due to player-to-player and/or player-to-object contact. For example, in one embodiment, a helmet constructed using principles described herein in respect of the helmet 10 may be a lacrosse helmet for protecting the head of a lacrosse player. As another example, in one embodiment, a helmet constructed using principles described herein in respect of the helmet 10 may be a football helmet for protecting the head of a football player. As another example, in one embodiment, a helmet constructed using principles described herein in respect of the helmet 10 may be a baseball helmet for protecting the head of a baseball player (e.g., a batter or catcher). Furthermore, a helmet constructed using principles described herein in respect of the helmet 10 may be for protecting the head of a wearer involved in a sport other than a contact sport (e.g., bicycling, skiing, snowboarding, horseback riding or another equestrian activity, etc.).

Also, while in the embodiments considered above the helmet 10 is a sport helmet, a helmet constructed using principles described herein in respect of the helmet 10 may be used in an activity other than sport in which protection against head injury is desired. For example, in one embodiment, a helmet constructed using principles described herein in respect of the helmet 10 may be a motorcycle helmet for protecting the head of a wearer riding a motorcycle. As another example, in one embodiment, a helmet constructed using principles described herein in respect of the helmet 10 may be a industrial or military helmet for protecting the head of a wearer in an industrial or military application.

Although various embodiments and examples have been presented, this was for the purpose of describing, but not limiting, the invention. Various modifications and enhancements will become apparent to those of ordinary skill in the art and are within the scope of the invention, which is defined by the appended claims.

The invention claimed is:

1. A helmet for protecting a head of a wearer, the helmet comprising:

a) an outer shell;

b) inner padding disposed within the outer shell, the inner padding comprising a plurality of pads configured to move relative to one another in response to an impact on the helmet; and c) an adjustment mechanism to adjust a fit of the helmet on the wearer's head, the outer shell comprising a first shell member and a second shell member that are movable relative to one another by operating the adjustment mechanism.

2. The helmet of claim 1, wherein the inner padding comprises a frame carrying the pads.

3. The helmet of claim 2, wherein the frame is disposed between the outer shell and the pads.

4. The helmet of claim 2, wherein the frame is deformable to allow the pads to move relative to one another in response to the impact on the helmet.

5. The helmet of claim 4, wherein the frame comprises a material having an elastic modulus of no more than 150 GPa.

6. The helmet of claim 5, wherein the elastic modulus of the material of the frame is no more than 50 GPa.

7. The helmet of claim 4, wherein the frame comprises a thermoplastic material.

8. The helmet of claim 4, wherein the frame comprises nylon or polycarbonate.

9. The helmet of claim 2, wherein the inner padding comprises connectors connecting the frame to the outer shell and deformable to allow the pads to move relative to one another in response to the impact on the helmet.

10. The helmet of claim 9, wherein the connectors are stretchable to allow the pads to move relative to one another in response to the impact on the helmet.

11. The helmet of claim 10, wherein each connector comprises an elastomeric material.

12. The helmet of claim 11, wherein the elastomeric material is rubber or a thermoplastic elastomer.

13. The helmet of claim 1, wherein a given one of the pads is omnidirectionally movable relative to another one of the pads in response to the impact.

14. The helmet of claim 2, wherein the frame is thinner than a given one of the pads.

15. The helmet of claim 14, wherein a ratio of a thickness of the frame over a thickness of the given one of the pads is no more than 0.5.

16. The helmet of claim 15, wherein the ratio of the thickness of the frame over the thickness of the given one of the pads is no more than 0.3.

17. The helmet of claim 2, wherein the frame comprises a plurality of frame members carrying respective ones of the pads and configured to move relative to one another in response to the impact on the helmet.

18. The helmet of claim 17, wherein the frame members are arranged into a network.

19. The helmet of claim 18, wherein the respective ones of the pads are attached at nodes of the network.

20. The helmet of claim 17, wherein the plurality of frame members comprises:

a plurality of pad supports to which the respective ones of the pads are attached; and a plurality of links interconnecting the pad supports.

21. The helmet of claim 20, wherein each link is elongated.

22. The helmet of claim 20, wherein given ones of the links are curved.

23. The helmet of claim 20, wherein each pad support is located where respective ones of the links intersect.

24. The helmet of claim 23, wherein the pad support comprises an enlargement where the respective ones of the links intersect.

25. The helmet of claim 23, wherein the respective ones of the links comprise at least three of the links.

26. The helmet of claim 17, wherein a front one of the frame members extends in a front part of the helmet and carries front ones of the pads and a rear one of the frame members extends in a rear part of the helmet and carries rear ones of the pads.

27. The helmet of claim 26, wherein at least one of the front one of the frame members and the rear one of the frame members comprises a plurality of openings.

28. The helmet of claim 2, wherein the frame is connected to the outer shell.

29. The helmet of claim 2, wherein the frame is connected to a remainder of the helmet in a lower edge region of the helmet.

30. The helmet of claim 2, wherein the frame is unconnected to a remainder of the helmet from an apex of the frame downwardly for at least one-quarter of a height of the frame.

31. The helmet of claim 30, wherein the frame is unconnected to the remainder of the helmet from the apex of the frame downwardly for at least half of the height of the frame.

32. The helmet of claim 1, wherein a range of motion of a first one of the pads relative to a second one of the pads in response to the impact on the helmet corresponds to at least 1% of a length of the helmet.

33. The helmet of claim 32, wherein the range of motion of the first one of the pads relative to the second one of the pads in response to the impact on the helmet corresponds to at least 5% of the length of the helmet.

34. The helmet of claim 1, wherein a range of motion of a first one of the pads relative to a second one of the pads in response to the impact on the helmet corresponds to at least 0.5% of a width of the helmet.

35. The helmet of claim 33, wherein the range of motion of the first one of the pads relative to the second one of the pads in response to the impact on the helmet corresponds to at least 1.5% of the width of the helmet.

36. The helmet of claim 1, wherein a range of motion of a first one of the pads relative to a second one of the pads in response to the impact on the helmet is at least 2.5 mm.

37. The helmet of claim 36, wherein the range of motion of the first one of the pads relative to the second one of the pads in response to the impact on the helmet is at least 5 mm.

38. The helmet of claim 1, wherein the plurality of pads includes at least three pads.

39. The helmet of claim 38, wherein the plurality of pads includes at least five pads.

40. The helmet of claim 1, wherein, when the adjustment mechanism is operated to set a maximal size of the helmet, a maximal gap between adjacent ones of the pads is no more than 20 mm.

41. The helmet of claim 40, wherein the maximal gap between the adjacent ones of the pads is no more than 10 mm.

42. The helmet of claim 1, wherein a given one of the pads comprises a polymeric cellular material.

43. The helmet of claim 42, wherein the polymeric cellular material comprises foam.

44. The helmet of claim 1, wherein a given one of the pads comprises elastomeric material.

45. The helmet of claim 1, wherein a first one of the pads comprises a first material and a second one of the pads comprises a second material different from the first material.

46. The helmet of claim 45, wherein the first material is denser than the second material.

47. The helmet of claim 45, wherein the first material is stiffer than the second material.

48. The helmet of claim 45, wherein a third one of the pads comprises a third material different from the first material and the second material.

49. The helmet of claim 1, wherein the pads are absorption pads and the inner padding comprises a plurality of comfort pads disposed to contact the wearer's head.

50. The helmet of claim 3, wherein the inner padding comprises a filler disposed between the frame and the outer shell.

51. The helmet of claim 50, wherein the filler comprises a plurality of filling members adjacent to one another.

52. The helmet of claim 50, wherein the filler comprises foam.

53. The helmet of claim 1, wherein a first subset of the pads is disposed between the frame and the outer shell and a second subset of the pads is disposed between the frame and the wearer's head when the helmet is worn.

54. A helmet for protecting a head of a wearer, the helmet comprising:

a) an outer shell;

b) inner padding disposed within the outer shell, the inner padding comprising:

i. a plurality of pads; and ii. a frame carrying the pads and configured to allow the pads to move relative to one another in response to an impact on the helmet; and c) an adjustment mechanism to adjust a fit of the helmet on the wearer's head, the outer shell comprising a first shell member and a second shell member that are movable relative to one another by operating the adjustment mechanism.

55. A helmet for protecting a head of a wearer, the helmet comprising:

a) an outer shell; and b) inner padding disposed within the outer shell, the inner padding comprising:

i. a plurality of pads; and ii. a frame carrying the pads, the frame comprising a plurality of frame members carrying respective ones of the pads and configured to move relative to one another in response to an impact on the helmet such that the respective ones of the pads are movable relative to one another in response to the impact on the helmet.

* * * * *